US007572181B2

(12) United States Patent
Seelig et al.

(10) Patent No.: US 7,572,181 B2
(45) Date of Patent: Aug. 11, 2009

(54) GAMING DEVICE WITH INDICATORS AND METHODS OF USE

(75) Inventors: Jerald Seelig, Absecon, NJ (US); Lawrence Henshaw, Hammonton, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 492 days.

(21) Appl. No.: 11/307,486

(22) Filed: Feb. 9, 2006

(65) Prior Publication Data

US 2006/0135249 A1 Jun. 22, 2006

Related U.S. Application Data

(63) Continuation-in-part of application No. 10/622,805, filed on Jul. 18, 2003, now Pat. No. 7,169,043.

(60) Provisional application No. 60/682,884, filed on May 19, 2005.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/16; 273/138.1; 273/138.2; 273/118; 273/143 R; 198/502.1; 463/20; 463/22; 463/26; 463/30

(58) Field of Classification Search ..... 463/25, 463/16

See application file for complete search history.

(56) References Cited

U.S. PATENT DOCUMENTS

| | | | | | |
|---|---|---|---|---|---|
| 1,736,244 | A * | 11/1929 | Baker | 273/368 |
| 1,927,876 | A * | 9/1933 | Meyer | 273/366 |
| 2,071,274 | A * | 2/1937 | Ross | 368/112 |
| 2,187,422 | A * | 1/1940 | Henry | 273/375 |
| 4,846,478 | A * | 7/1989 | Saint-Cricq | 473/153 |
| 5,664,998 | A * | 9/1997 | Seelig et al. | 463/20 |
| 5,680,534 | A * | 10/1997 | Yamato et al. | 345/473 |
| 5,735,379 | A * | 4/1998 | Schulze et al. | 194/346 |
| 6,139,017 | A * | 10/2000 | Kawamura | 273/445 |
| 6,446,964 | B1 * | 9/2002 | Kelly et al. | 273/138.1 |
| 6,561,512 | B2 * | 5/2003 | Luciano et al. | 273/142 HA |
| 6,598,877 | B1 * | 7/2003 | Luciano et al. | 273/142 R |
| 6,712,694 | B1 * | 3/2004 | Nordman | 463/20 |
| 6,824,463 | B1 * | 11/2004 | Yamaguchi et al. | 463/17 |
| 6,905,405 | B2 * | 6/2005 | McClintic | 463/16 |
| 7,021,624 | B2 * | 4/2006 | Luciano et al. | 273/142 HA |
| 7,086,950 | B2 * | 8/2006 | Gordon et al. | 463/42 |
| 7,153,209 | B2 * | 12/2006 | Rothkranz et al. | 463/22 |
| 7,169,045 | B2 * | 1/2007 | Nordman | 463/20 |
| 7,226,358 | B2 * | 6/2007 | Miller et al. | 463/20 |
| 7,258,609 | B2 * | 8/2007 | Nordman et al. | 463/20 |

(Continued)

*Primary Examiner*—John M. Hotaling, II
*Assistant Examiner*—Paul Anthony D'Agostino
(74) *Attorney, Agent, or Firm*—Ian F. Burns & Associates, P.C.

(57) ABSTRACT

A gaming device is disclosed that includes a housing and a display device associated with the housing. The display device displays several indicia. A positioning mechanism is configured to move the display device. Several indicators are associated with the display device. A controller is in communication with the positioning mechanism and the indicators. The controller determines a game outcome and directs movement of the display device. The controller can illuminate at least one of the indicators in order to display the game outcome.

19 Claims, 14 Drawing Sheets

U.S. PATENT DOCUMENTS

| | | | | |
|---|---|---|---|---|
| 7,278,638 | B2 * | 10/2007 | Nordman | 273/292 |
| 7,338,366 | B2 * | 3/2008 | Rosander et al. | 463/16 |
| 7,371,172 | B2 * | 5/2008 | Inoue | 463/20 |
| 2002/0151339 | A1 * | 10/2002 | Huang | 463/12 |
| 2003/0104855 | A1 * | 6/2003 | McClintic | 463/16 |
| 2003/0148804 | A1 * | 8/2003 | Ikeya et al. | 463/16 |
| 2004/0009800 | A1 * | 1/2004 | Huang | 463/12 |
| 2004/0023710 | A1 * | 2/2004 | McGahn et al. | 463/16 |
| 2004/0209682 | A1 * | 10/2004 | Okada | 463/31 |
| 2006/0024034 | A1 * | 2/2006 | Filo et al. | 386/125 |
| 2006/0068882 | A1 * | 3/2006 | Baerlocher et al. | 463/20 |
| 2006/0084485 | A1 * | 4/2006 | Elias | 463/16 |
| 2006/0205474 | A1 * | 9/2006 | Bansemer et al. | 463/16 |
| 2008/0045294 | A1 * | 2/2008 | Seelig et al. | 463/16 |

* cited by examiner

GAMING DEVICE WITH INDICATORS AND METHODS OF USE

CROSS REFERENCE TO RELATED APPLICATIONS

The application is a continuation-in-part of U.S. patent application Ser. No. 10/622,805 filed Jul. 18, 2003 now U.S. Pat. No. 7,169,043. The application also claims priority to U.S. provisional patent application Ser. No. 60/682,884, filed May 19, 2005 the contents of which are herein incorporated by reference.

FIELD OF THE INVENTION

The present invention relates to gaming devices and, more particularly, to a gaming device having indicators to indicate a prize to a player.

BACKGROUND

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number (hereinafter, both types are referred to as a "random number").

The random number can be used to determine a game outcome. For example, the random number may then be compared to a predefined table to determine a corresponding outcome of the event. If the random number falls within a certain range of numbers on the table, the player may win the corresponding predefined prize. The table may also contain display information that allows the gaming device to generate a display that corresponds to the outcome of the game. The gaming device may present the outcome of the game on a large variety of display devices, such as mechanical spinning reels or video screens.

Some gaming devices award bonus prizes in addition to prizes that are awarded in a primary game. Of course, the prize in the primary game may simply be the opportunity to play the bonus game. A bonus prize is generally defined as a prize in addition to the prize obtained from the primary game and that is awarded to the player when a predefined event occurs. An example of a bonus game can be found in U.S. Pat. No. 5,848,932 to Adams. Adams discloses a primary game having three spinning game reels and a bonus game having a bonus display with one spinning wheel. The spinning wheel is divided into multiple sections, and each section has a symbol representing a prize. When predetermined indicia are displayed on the spinning game reels of the primary game, the wheel of the bonus display spins and stops. The bonus prize is displayed as the symbol on the wheel being pointed to by a pointer. The bonus prize is awarded in addition to any prizes awarded in the primary game. Another bonus game is disclosed in Baerlocher et al. (U.S. Pat. No. 6,336,863). Baerlocher et al. discloses a slot machine with a bonus award display. The bonus award display has a bonus wheel and a mechanical, movable pointer.

One of the problems associated with the devices disclosed in these references is that the outcome of the bonus game is communicated to the player almost immediately. When a bonus game is triggered, a bonus award is selected, displayed, and awarded to the player. The player can see what the outcome of the game is immediately after the pointers have stopped moving. What has long been needed is a device that utilizes intermediate steps between the occurrence of the bonus event and the awarding of the bonus prize to add an additional element of anticipation and excitement for the players. It is further desired that the intermediate steps involve an eye-catching display. Another problem associated with Adams and Baerlocher et al. is that they utilize a plain combination of wheel and pointer. The applicants have discovered more things that can be done to display devices to make them more attractive and interesting to play.

Generally, bonus prizes are awarded in order to increase the excitement and enjoyment experienced by players, which attracts more players to the game and encourages players to play longer. When this occurs, the gaming devices tend to be more commercially successful relative to other gaming devices. A shortcoming of present bonus games is that they do not sufficiently allow players to interact with the gaming device, including during bonus games.

Other attempts have been made to provide player interaction. U.S. Pat. No. 5,788,573 to Baerlocher et al. (hereinafter, "Baerlocher") purports to suggest a gaming device with an electronic "wheel of fortune game." Several flippers appear to indicate positions on the wheel. Baerlocher appears to suggest that the player may be allowed to choose which flipper is used to select an indicia on the wheel. However, the player does not appear to have any control over the position of the flipper and the flippers do not appear to be capable of moving to different positions.

U.S. Pat. No. 6,309,300 to Glavich (hereinafter, "Glavich") and U.S. Pat. No. 6,439,995 to Hughs-Baird et al. (hereinafter, "Hughs-Baird") purport to suggest a gaming system having a bonus feature where a player may be allowed to select a number of selectable items, which may be prize representations, on a video display. Glavich and Hughs-Baird do not appear to suggest using prize indicators, moveable prize indicators, or allowing a player to select a prize indicator.

SUMMARY

Advantages

The various embodiments of the present invention may, but do not necessarily, achieve one or more of the following advantages:

provide a highly attractive and entertaining device for conducting games;

provide a highly attractive and entertaining device for displaying prizes;

the ability to attract more patrons to play a game;

the ability to encourage players to play longer on a gaming apparatus;

provide at least one attractive prize indicator;

provide a unique combination of a belt type display and indicator;

allow players to control the selection of a prize indicator;

provide a moving prize belt;

provide a moving display and an moving indicator;

provide a display that allows for a relatively larger number of indicia to be displayed;

create additional suspense for players by increasing the length of time between the start of a game and the display of the game outcome;

allow players to control the movement of an indicator;

provide the illusion that the player can influence the outcome of a game;

provide a game that allows for more player interaction;

provide an additional element of anticipation and excitement for players;

These and other advantages may be realized by reference to the remaining portions of the specification, claims, and abstract.

BRIEF DESCRIPTION OF CERTAIN ASPECTS OF THE INVENTION

In one embodiment, the present invention comprises a gaming device that includes a housing and a display device associated with the housing. The display device displays several indicia. A positioning mechanism is configured to move the display device. Several indicators are associated with the display device. A controller is in communication with the positioning mechanism and the indicators. The controller determines a game outcome and directs movement of the display device. The controller can illuminate at least one of the indicators in order to display the game outcome.

In at least one alternative embodiment, the present invention is directed to a gaming method. The method includes providing a gaming device. The gaming device has several indicators and a moveable belt. The moveable belt has several indicia. A player is allowed to place a wager. A game outcome is determined. The game outcome corresponds to and is conveyable by at least one indicia appearing on the moveable belt. The belt is moved. The belt is stopped. At least one of the indicators is illuminated. The combination of the stopped belt and the illuminated indicator indicate an indicia on the moveable belt corresponding to the game outcome.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Certain embodiments of the invention are shown in the accompanying drawings wherein.

DESCRIPTION OF AT LEAST ONE EMBODIMENT OF THE PRESENT INVENTION

Game Apparatus

In the following detailed description of at least one embodiment of the present invention, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
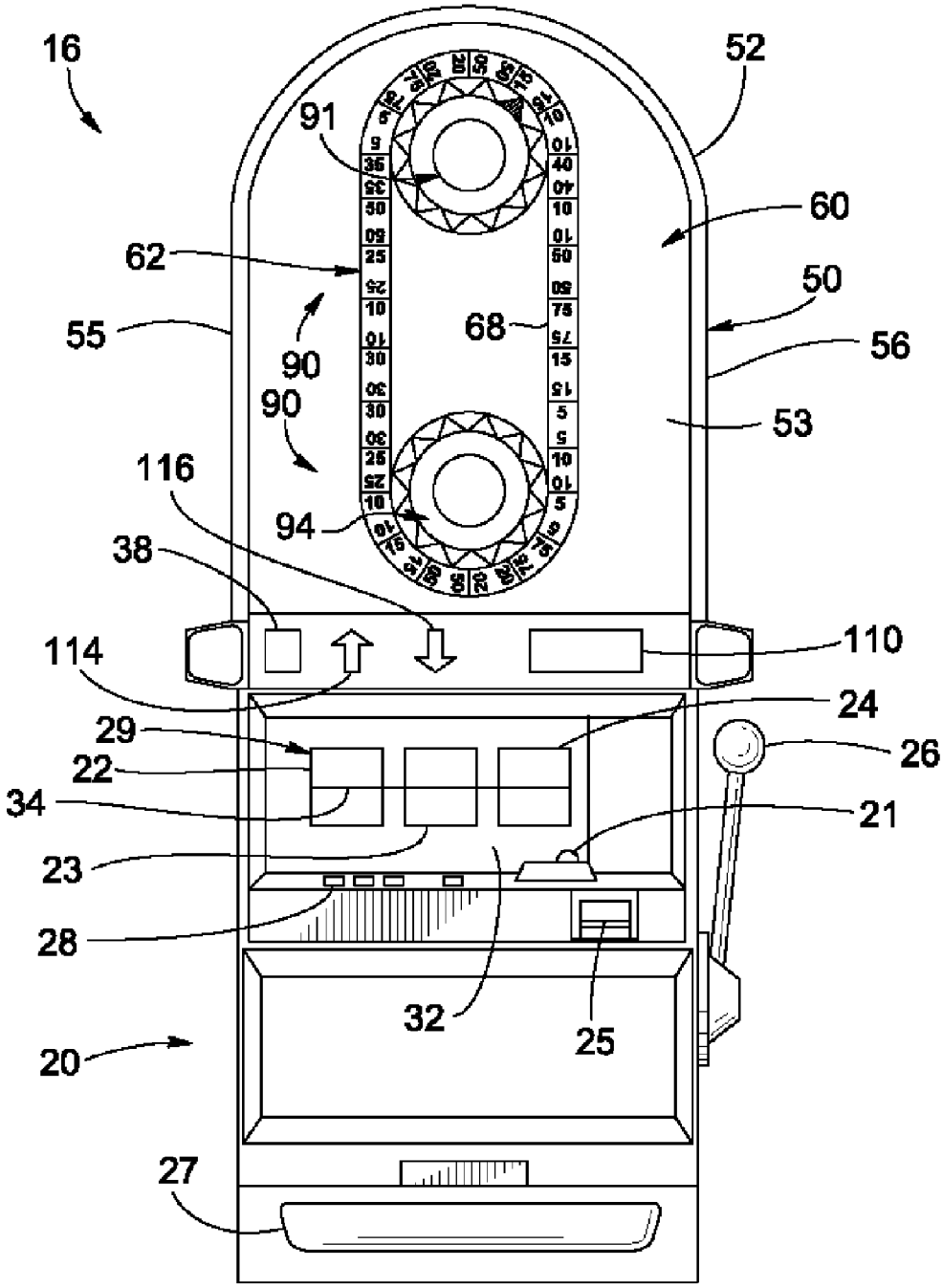
FIG. 1 is substantially a front elevation view of an embodiment of the gaming apparatus of the present invention.

As seen in FIG. 1, the present invention comprises a gaming apparatus, generally indicated by reference number 16. In at least one embodiment, gaming apparatus 16 comprises a bonus game apparatus 50 and a primary gaming device 20. Gaming device 20 may be any of a large number of devices that are adapted to allow players to play a game, such as gaming devices typically found in arcade and casino environments, including arcade games, video games, gambling machines, video poker machines, slot machines, etc. In at least one embodiment, gaming device 20 is further adapted to allow a player to place a wager and play a game, such as a slot machine.

Gaming device 20 may include a value acceptor for accepting value (including currency and/or currency equivalents), such as a coin slot 21 and card or voucher reader 25. In addition, a payout mechanism (not shown) and a coin receptacle 27 may be provided for awarding prizes or for dispensing value to players cashing out and retiring from a game. A printer (not shown) may also be provided for printing out cashless vouchers (not shown). A handle 26 and a button 28 may be provided for activating gaming device 20 to begin a game. A pay table (not shown) may further be provided to allow a player to see what symbol or combination of symbols provide a winning event. In at least one preferred embodiment, gaming device 20 may be a S2000 or S Plus model gaming device manufactured by International Game Technology in Reno, Nevada.

Gaming device 20 may further include a gaming outcome display 29 that may be positioned in front of the gaming device 20 so that a player (not shown) playing gaming device 20 can view gaming outcome display 29. Gaming outcome display 29 may utilize physical game reels 22, 23, and 24. Game reels 22, 23, and 24 may be attached to a drive mechanism (not shown) of gaming device 20 to rotate the reels in a manner well known in the art. Each game reel 22, 23, and 24 may have a plurality of symbols positioned on the circumference of each game reel 22, 23, and 24. Game reels 22, 23, and 24 may be positioned side-by-side with coincident axes of rotation and a portion of their individual circumferences may face outward from gaming device 20.

A panel 32 may cover game reels 22, 23, and 24 such that only a portion of their individual circumferences is shown to the player. At least one symbol from any of game reels 22, 23, and 24 may be used to display a game outcome. At least one pay line 34 may be provided for the player to use in determining a game outcome based on the symbol or a combination of symbols positioned thereon. In an alternative embodiment, gaming outcome display 29 utilizes a video display (not shown) displaying images of game reels and an image of at least one pay line. A video display may also display game symbols in many other formats and arrangements, such as playing cards. Of course, the invention is not limited to any particular type of gaming outcome display. Those of skill in the art will recognize that many different types of gaming outcome displays could be substituted without departing from the scope of the present invention.

Game apparatus 20 is preferably controlled by an electronic controller 182 (see FIG. 5) that utilizes a random number generator. The random number generator produces a random or pseudo random number for each game. The outcome of the game may be determined by comparing the random number to a table of outcomes stored in a memory and accessed by controller 182. A number of different tables of outcomes may be used and different tables may be used for different games. The tables can be designed so that different prizes have different probabilities of being awarded. Such design techniques are well known in gaming. Examples of such designs are shown in U.S. Pat. No. 4,448,419, issued to Telnaes, and U.S. Pat. No. 5,456,465, issued to Durham. Controller 182 causes spinning reels 22-24 of the video display to show the outcome of the game that corresponds to the outcome of the random number generator. It is recognized that game apparatus 20 may operate in many other ways and still achieve the objects of the present invention.

Game apparatus 20 may also be capable of producing a bonus-activating event. This event may be many different types of events. For example, a bonus-activating event may comprise displaying a particular symbol, such as a "bonus" symbol, or combination of symbols, such as three "7" symbols, on reels 22-24. If the game being played is poker based, the bonus-activating event may be occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result.

Bonus Game

Gaming apparatus 16 may include a second game or bonus game 50 configured to display at least one game and prize to a player. Bonus game 50 can have a display device 60. In at least one embodiment, display device 60 is configured to display a bonus game and at least one bonus prize to the player. In other embodiments, display device 60 may provide a primary game. Alternatively, display device 60 may be a stand-alone device allowing a player to place a wager and play a game.

In at least one embodiment, display device 60 is attached to gaming device 20 and positioned on top of gaming device 20. In other embodiments (not shown), display device 60 may be separate from gaming device 20 but in communication with gaming device 20. In this embodiment, gaming device 20 may be in communication with a plurality of different gaming devices 20 via a computer network in a manner that is well known in the art. Display device 60 may also be positioned adjacent to or remote from gaming device 20. In other embodiments, display device 60 is a stand-alone display not in communication with gaming device 20, and it may be capable of independently accepting wagers, conducting games, and awarding prizes to a player.

With continued reference to FIGS. 1-4, bonus game 50 may comprise a housing 52. Housing 52 can have a front panel 53, rear panel 54, side panels 55 and 56. The panels can define an internal space or cavity 58. Housing 52 may be made in many different shapes and from any suitable material such as metal or plastic. Housing 52 can include decorative coverings or attachments and lights. Front panel 53 has at least one portion that is transparent defining a window 59 such that display device 60 can be viewed by a game player looking through window 59. Display device 60 is mounted in housing 52. A frame 76 supports display device 60 in housing 52. Display device 60 can have a button 38 that is used to activate display device 60 and a display 110 that is used to display prizes or credits won on bonus game 50.

Display device 60 may comprise a prize belt or prize band or material 62 that rotates about a plurality of rollers 72 and 74. Prize belt 62 can have an outer surface 63, an inner surface 64, a front surface 65 and a back surface 66. Prize belt 62 can have a plurality of prize positions 67 located on front surface 65. Prize belt 62 may have a plurality of prize indicia 68 appearing on front surface 65 in prize positions 67. Front surface 65 can be relatively wide in order to hold indicia 68 that are large enough to be easily readable. Indicia 68 may indicate various prizes, such as an award of currency or credits, merchandise, services, game play, jackpots, and progressive prizes. Prize belt 62 may have a variety of different indicia 68 imprinted or otherwise appearing thereon. Indicia 68 may vary in number, size and content. It may be desirable to arrange indicia 68 on belt 62 such that enough of each type of indicia 68 are included in order that any indicia can be indicated at any position to which belt 62 is moved.

Figure 2:
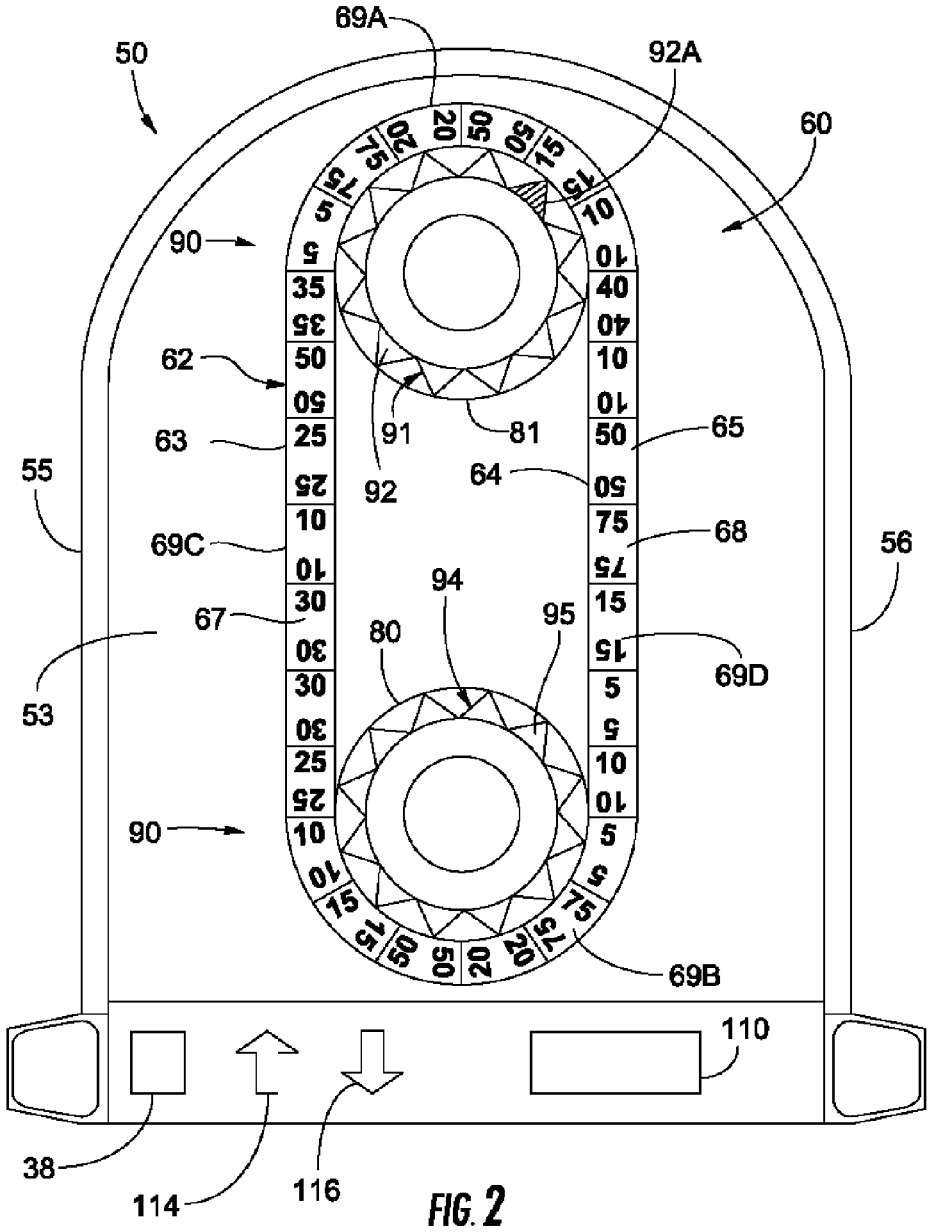
FIG. 2 is substantially a front view of the bonus gaming apparatus of FIG. 1 showing an embodiment of a display device.

Indicia 68 can be arranged in a duplicate manner in each prize position 67 as is shown in FIG. 2. The duplicate indicia are arranged to be opposite or a mirror image to each other. Some of the indicia would appear upright and some would appear to be upside down. The use of duplicate indicia allows at least one of the duplicate indicia to be viewable by the game player in an upright readable manner regardless of the belt position.

Belt 62 can have curved portions 69A and 69B that wrap around a pair of rollers and elongated portions 69C and 69D that extend between the rollers.

Belt 62 may resemble a conveyor belt. Belt 62 may be constructed from any suitable material. Belt 62 may be constructed from a flexible material, such as various types of vinyl, plastic, rubber materials, and the like. The use of a flexible material may prevent belt 62 from tearing when it is moved. The material used to construct belt 62 may be transparent or translucent, allowing belt 62 to be backlit.

In an alternative embodiment, belt 62 may also be formed from several pivotally connected segments and may resemble a tractor tread.

Figure 3:
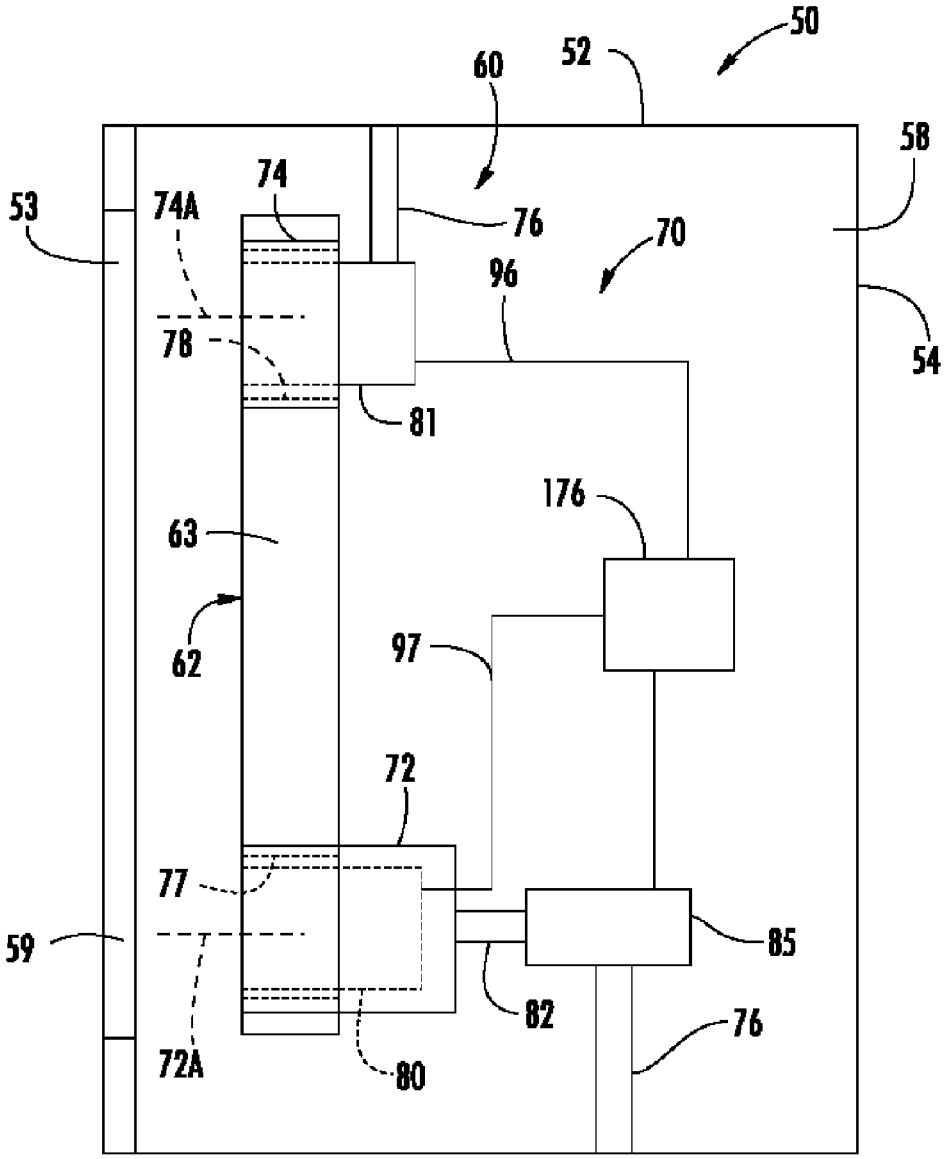
FIG. 3 is substantially a side elevation view of one embodiment of a display device and positioning mechanism of the present invention.
Figure 4:
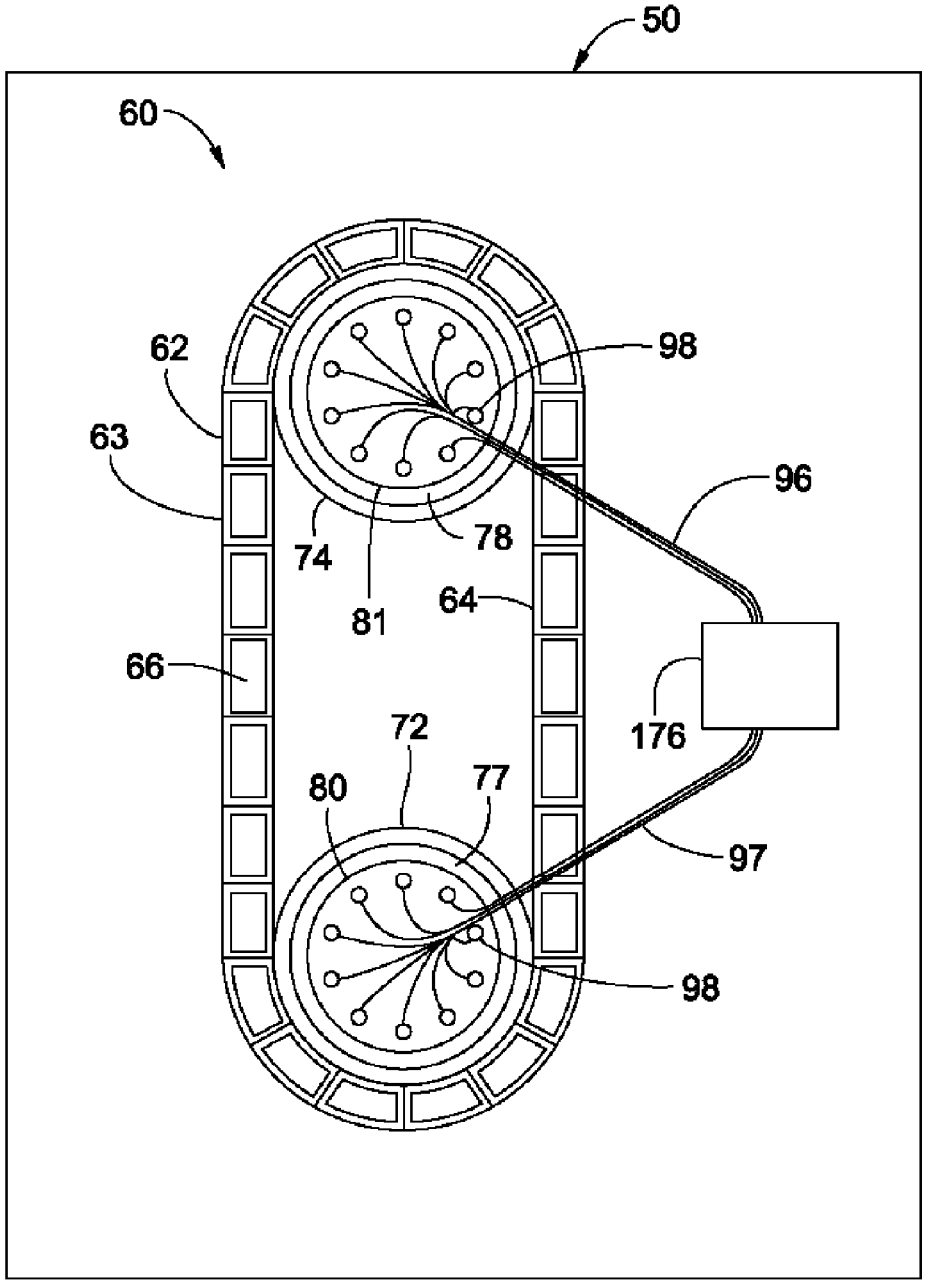
FIG. 4 is substantially a rear elevation view of one embodiment of a display device of the present invention.

Belt 62 may be coupled to a display or belt positioning mechanism 70 so that belt 62 may be rotated about rollers 72 and 74. FIGS. 3 and 4 illustrate belt 62 wrapped around rollers 72 and 74. Rollers 72 and 74 are in frictional contact with inner surface 64. Roller 72 has an axis of rotation 72A and roller 74 has an axis of rotation 74A. The axes of rotation 72A and 74A are perpendicular to the length of belt 62. Positioning mechanism 70 comprises roller 72 that is a driven roller and roller 74 is an idle roller. Bearing 77 is located between driven roller 72 and a stationary hub 80. Bearing 78 is mounted between idle roller 74 and a stationary hub 81. Driven roller 72 may be connected by a shaft 82 to a stepper motor or actuator 85 in order to drive rotation of driven roller 72. Actuator 85 may be any number of suitable actuators, such as motors, including stepper motors, gear motors, and servo motors. Actuator 85 is in communication with a controller 176.

In at least one embodiment, belt 62 is driven simply by frictional contact between belt 62 and driven roller 72. A tensioning mechanism (not shown) can be provided to maintain the proper tension on belt 62.

Front surface 65 is oriented such that it is visible to a game player looking into window 59. When viewed by the game player, the entire front surface 65 is visible including the portions 69A and 69B that wrap around rollers 72 and 74 and the elongated portions 69C and 69D that extend between the rollers. It is noted that the axis of rotation of belt 62 is parallel to the line of sight of a game player viewing the belt. This allows the entire front surface 65 of the belt including portions 69A-69D to be viewed in a rotating manner by the game player.

In at least one embodiment, indicators 90 can be mounted to hubs 80 and 81. Indicators 90 can include an upper set of indicators 91 and a lower set of indicators 94. Upper set of indicators 91 can include a plurality of individual indicators 92. Lower set of indicators 94 can include a plurality of individual indicators 95. Upper set of indicators 91 can be mounted to upper hub 81 and lower set of indicators 94 can be mounted to lower hub 80.

Indicators 90 preferably are made from a translucent material, such as plastic, and include one or more lights 98 mounted within indicators 90. Lights 98 can call attention to indicators 90 and make indicator 90 more attractive. Lights 98 may be of any suitable type, including light emitting diodes (LEDs). Lights 98 can be in communication with and connected to controller 176 through wire harnesses 96 and 97. Therefore, the illumination of indicators 90 can be controlled by controller 176.

In at least one embodiment, one of lights 98 are turned on or illuminated such that one of indicators 90 points to a selected prize on belt 62 and indicates a game outcome to the game player. Controller 176 can individually control lights 98.

While indicators 90 are shown as stationary, it is contemplated that indicators 90 could be made to rotate along with hubs 80 and 81. Indicators 90 could be made to rotate in the same direction that belt 62 rotates or could rotate opposite the direction of rotation of belt 62. If indicators 90 are rotated, a mechanism (not shown) would be needed to allow lights 98 to move and be supplied with power. In this example, controller 176 could control the position of indicators 90 and direct indicators 90 to start and stop rotation.

Turning to FIGS. 1 and 2, bonus game 50 also has player input devices 114 and 116 that allow the player to indicate his or her choice. In one preferred embodiment, player input devices 114 and 116 are buttons that allow the player to select one of indicator sets 91 and 94 to display a prize. For example, the player would press the left button 114 to select the upper set of indicators 91 to point to a prize indicia 68. The player would press the right button 116 to select the lower set of indicators 92 to point to a prize indicia 68. Alternatively, a touch screen (not shown) may be provided in place of or in addition to buttons 114 and 116.

Player input devices 114 and 116 allow a game player to partially control the outcome of bonus game 50. While the player is allowed to select which set of indictors 91 or 94 display the prize indicia, the final prize indicia 68 that is displayed is controlled by controller 176.

Figure 5:
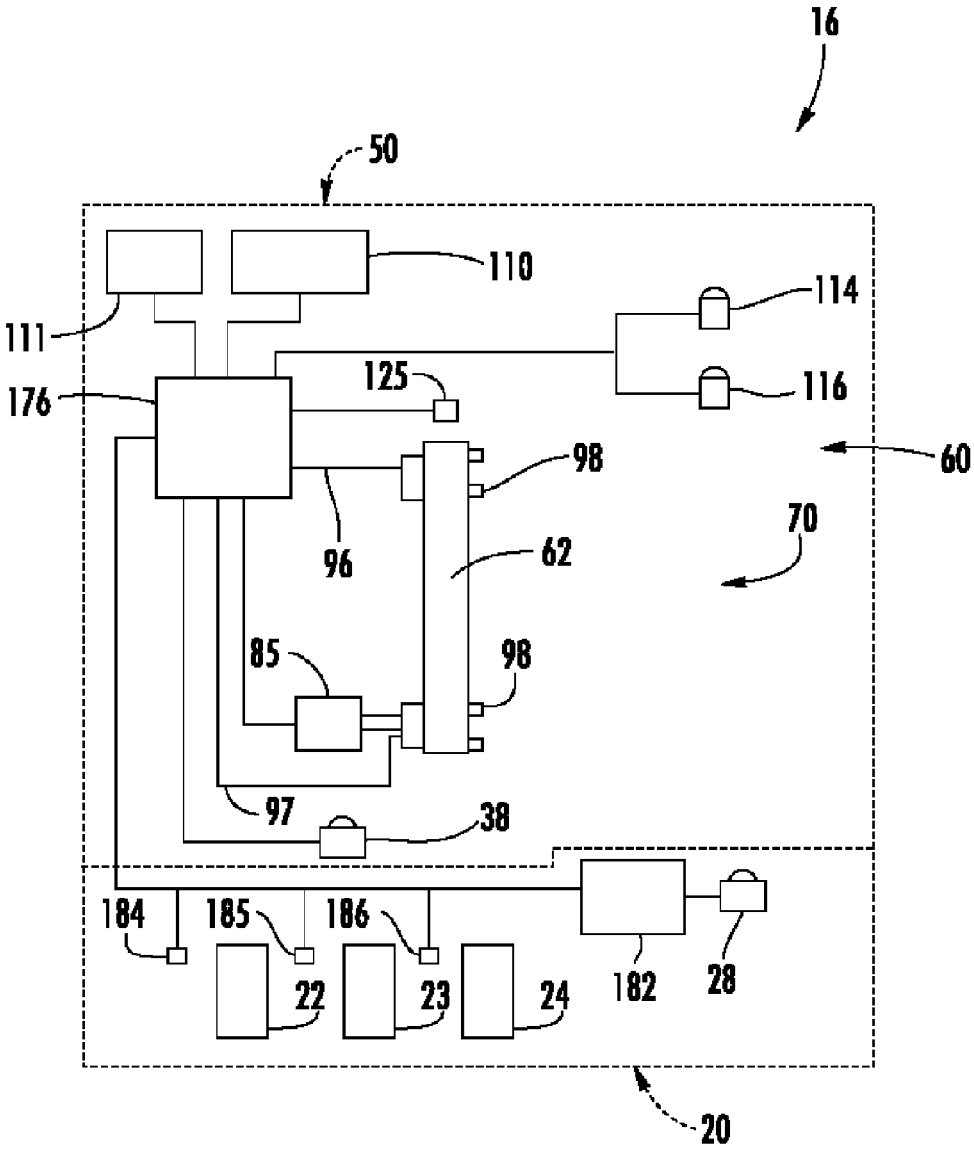
FIG. 5 is substantially a schematic diagram showing components of an embodiment of the gaming apparatus of FIG. 1.

The use of the player input devices 114 and 116 provides the game player with the illusion of a sense of control over the game. Of course, regulatory concerns may dictate that the player's perceived control be largely or completely illusionary. Turning now to FIG. 5, bonus game apparatus 50 comprises a controller 176 that is adapted to control the operation of the game apparatus. Controller 176 may be one or more computers or processor boards. For example, in the presently implemented embodiment, controller 176 comprises a bonus controller and stepper motor controller. It is recognized that controller 176 may be a single processor or processor board. Furthermore, it is also recognized that controller 176 and controller 182 may be combined in a single processor or processor board.

Controller 176 is adapted to detect when a bonus activating event occurs in game apparatus 20. This may be accomplished by game apparatus controller 182 transmitting a signal to controller 176 that a bonus event has occurred. For example, controller 182 may determine the outcome of each game and when a bonus-activating outcome occurs, it transmits a signal to controller 176. Alternatively, controller 716 may periodically interrogate controller 182. In another embodiment, one or more sensors may be provided for determining if a bonus activating event has occurred. For example, sensors 184-186 may sense the positions of reels 22-24. When reels 22-24 are in a bonus activating position, controller 176 would sense this position and begin a bonus sequence (described below). Sensors may also be provided external to gaming device 16 to detect external bonus-activating events.

Controller 182 may also transmit a variety of information to controller 176. For example, controller 182 may signal when coins or currency have been inserted, when a game starts, when an error has occurred, and when a sensor detects tampering.

When controller 176 detects a bonus-activating event, it may begin a bonus sequence by activating display 110. Display 110 may comprise many different kinds of display devices, such as video screens, lights, light emitting diodes, etc. Display 110 may comprise its own controller that is adapted to generate a variety of displays.

Display 110 may indicate that a player has qualified for a bonus round and prompt the player to perform an action. In the preferred embodiment, the player is prompted to activate the bonus sequence by pressing input device 38. Input device 38 may be a simple button, a keyboard, or a touch screen display. In the embodiment in which the player must accumulate a number of bonus symbols to qualify for a bonus, display 110 may indicate the number of symbols the player has received.

When controller 176 detects input device 38 being activated, the controller would activate stepper motor or actuator 85 causing belt 62 to begin to rotate or spin. Stepper motor 85 is connected to belt 62 by a shaft 82. Alternatively, the belt 62 may begin to rotate automatically after the detection of a bonus qualifying event. In another embodiment, controller 176 may wait a predetermined time period for the player to activate input device 38. If the player does not activate input device 38 in that time period, controller 176 would automatically activate display device 60 and initiate the display sequence.

Controller 176 performs a routine to determine which prize indicia 68 will be stopped or displayed in a particular position. This may be performed by a number of methods that are well known in the art. For example, prize indicia 68 may be sequentially displayed or displayed based on external events, such as certain bonus activating events may always cause the same prize ball to be displayed.

In an embodiment, however, prize indicia 68 are randomly selected. Controller 176 generates a random number and then compares the random number to a pay table similar to that described for game apparatus 20 or as described in U.S. Pat. No. 5,823,874, issued to Adams. A simple pay table may appear as follows:

TABLE 1

| Random Number | Bonus Credits | Amount Paid |
|---|---|---|
| 0.00 to 0.50 | 5 | $5.00 |
| 0.51 to 0.75 | 10 | $10.00 |
| 0.76 to 0.95 | 20 | $20.00 |
| 0.96 to 1.00 | 75 | $75.00 |

For example, if the random number generator produced 0.65, 10 credits would be displayed and $10.00 would be awarded to the player. If the random number generator produced 0.80, 20 credits would be displayed. Other awards such as prize multipliers of some amount produced by game apparatus 20 can also be used. Gaming apparatus 20, for instance, may award $20 and the multiplier prize object would multiply this by two, awarding the player $40.

This embodiment is not necessarily limited to the example pay table shown. A greater number of prize objects may be used and, as will be discussed below, a combination of prize objects may be displayed. Furthermore, different kinds of prizes, besides monetary prizes, may be awarded. For example, the prizes may be goods, services, or additional games. The goods and services may be awarded in the form of physical objects, tickets, vouchers, coupons, etc. Additional games may be presented in the form of tickets, such as scratch off lottery tickets. In the embodiments in which tickets, vouchers, and coupons are used, the objects are dispensed using an internally or externally mounted dispenser 111. Such dispensers are well known in the art.

Once controller 176 determines the prize indicia 68 to be displayed and the prize to be awarded, the controller activates a positioning mechanism 70. Positioning mechanism 70 is adapted to position and indicate at least one selected prize indicia 68 so that it can be displayed. Positioning mechanism 70 may utilize a large variety of devices to achieve its purpose. In an embodiment, belt 62 is moved to a position where one of indicators 90 are illuminated to point to one of prize indicia 68. Front belt surface 65 has indicia 68 positioned thereon. Thus, indicia 68 may be positioned by rotating belt 62.

Positioning mechanism 70 comprises a stepper motor 85 for rotating and stopping belt 62. A sensor 125 can be provided for determining the position of belt 62. The position of each indicia 68 is stored in memory in controller 176. Stepper motor 85 can stop belt 62 at the location determined by the random number generator.

Sensor 125 can be any suitable sensor. For example, sensor 125 may be an infrared source and detector and belt outer surface 63 may comprise portions with different reflective characteristics, such as physical holes or gaps or absorbent paint lines.

Alternatively, a side of belt 62 can contain a series of holes (not shown), cut-out portions, or similar optical interrupts. The optical interrupts may be read by an optical reader (not shown). The optical interrupts may convey the position of belt 62 to controller 176. Sensor 125 may be used to verify that the belt is in the proper position. If sensor 125 does not detect the belt in its proper position, controller 176 may enter an error mode.

In normal operation, after controller 176 has determined which prize indicia 68 is to be displayed, the controller rotates belt 62 until the desired prize indicia 68 is aligned with the desired indicator 90 that is to be illuminated. At the appropriate time, controller 176 stops belt 62 and illuminates or turns on one of lights 98 behind a corresponding indicator 90. This allows the game player to view a prize through window 59. In FIG. 2, an indicator 92A is illuminated pointing to a prize of 15 credits.

Controller 176 may then cause display 110 to display the prize, if any, that the player has won. Other effects may also be presented, such as pre-recorded sound from speakers. If the actual prize is money, the amount of the prize may be added to the player's credit meter or the prize may be dispensed from dispenser 111 or coin dispenser 27.

Combinations of prize indicia 68 can be used to indicate various bonus outcomes. For example, one of the upper set of indicators 91 could point to a prize indicia and one of the lower set of indicators 94 could point to another prize indicia. The two prize indicias could be added and awarded as a total prize to the game player.

In an alternative embodiment, one of indicators 90 can first be illuminated and then the rotation of belt 62 can be stopped in order to display a game outcome.

It is also possible to replace the primary display of a gaming device with display device 60. Game apparatus 20 may be entirely replaced by display device 60. In other words bonus gaming apparatus 50 can be used as a primary or base game apparatus.

In another embodiment, the player could be allowed to select which set of indicators points to the prize or game outcome. For example, the player could use player input devices 114 and 116 to select one of indicator sets 91 and 94 to display a prize. The player could press the left button 114 to select the upper set of indicators 91. Controller 176 would then rotate and stop belt 62 and illuminate one of the indicators 92 to display the game outcome. Alternatively, belt 62 could be stopped prior to the game player's selection using input devices 114 and 116.

Figure 6:
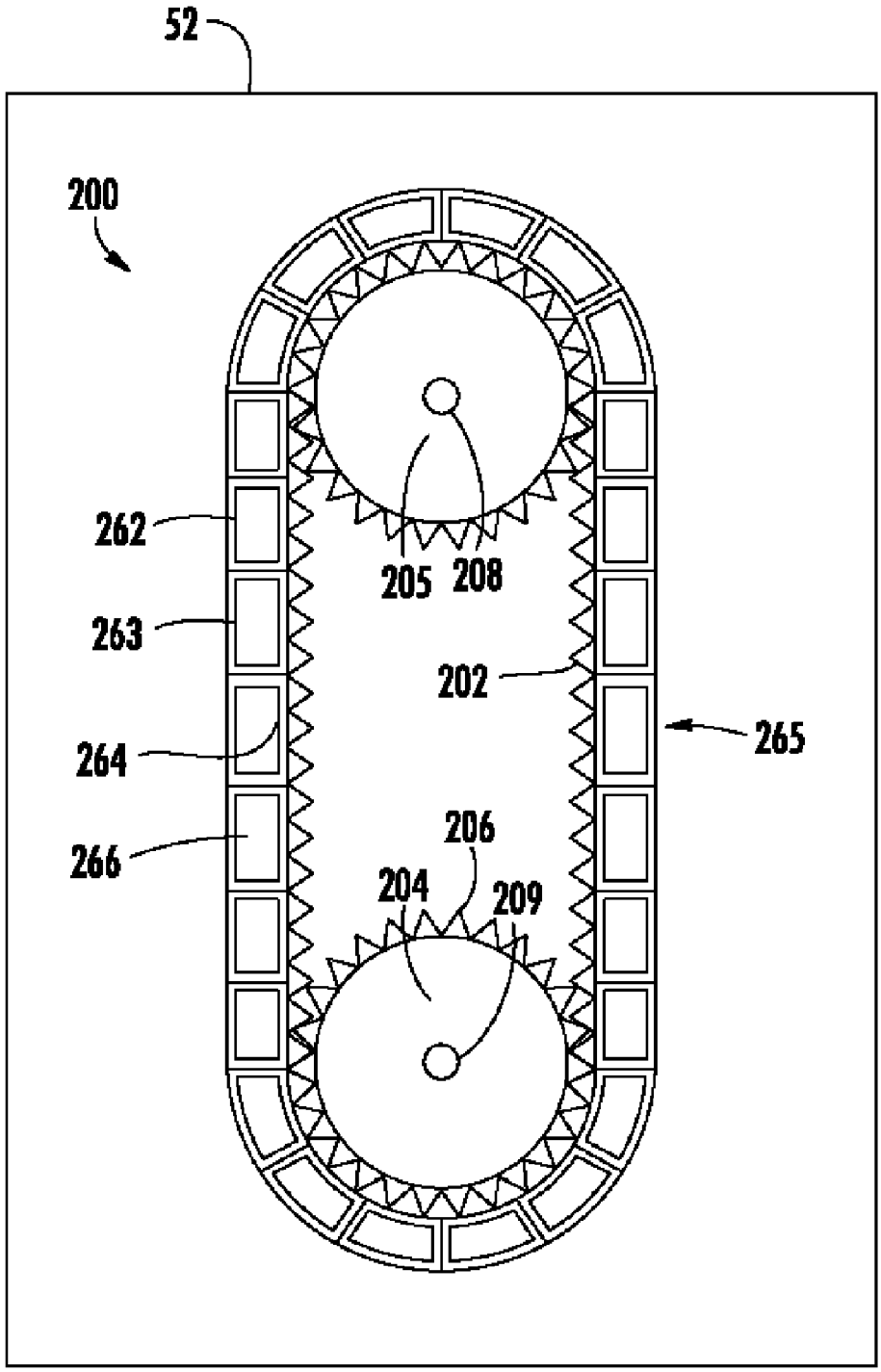
FIG. 6 is substantially a rear elevation view of an alternative embodiment of a display device of the present invention.

Referring to FIG. 6, a rear view of an alternative embodiment of a display device 200 is shown. Display device 200 has a prize belt 262. Prize belt 262 is similar to the prize belt 62 shown in FIGS. 2-4, except that prize belt 262 maybe supported and driven by gears 204 and 205.

Prize belt 262 can have an outer surface 263, an inner surface 264, a front surface 265 and a back surface 266. Prize belt 262 may have a plurality of prize indicia (not shown) appearing on front surface 265.

Belt 262 may resemble a conveyor belt. Belt 262 may be constructed from any suitable material. Belt 262 may be constructed from a flexible material, such as various types of vinyl, plastic, rubber materials, and the like. The use of a flexible material may prevent belt 262 from tearing when it is moved. The material used to construct belt 262 may be transparent or translucent, allowing belt 262 to be backlit.

Prize belt 262 has teeth 202 arranged around the length of inner surface 264. Gears 204 and 205 have teeth 206. Gears 204 and 205 are supported for rotation by shafts 208 and 209. Teeth 202 and 206 mesh with each other.

Belt 262 may be coupled to a positioning mechanism 70 (FIG. 3) so that belt 262 may be rotated. Shaft 208 can be connected to stepper motor or actuator 85 in order to drive rotation of gear 205 and belt 262. Prize belt 262 would be operated in the same manner as previously described for prize belt 62.

Figure 7:
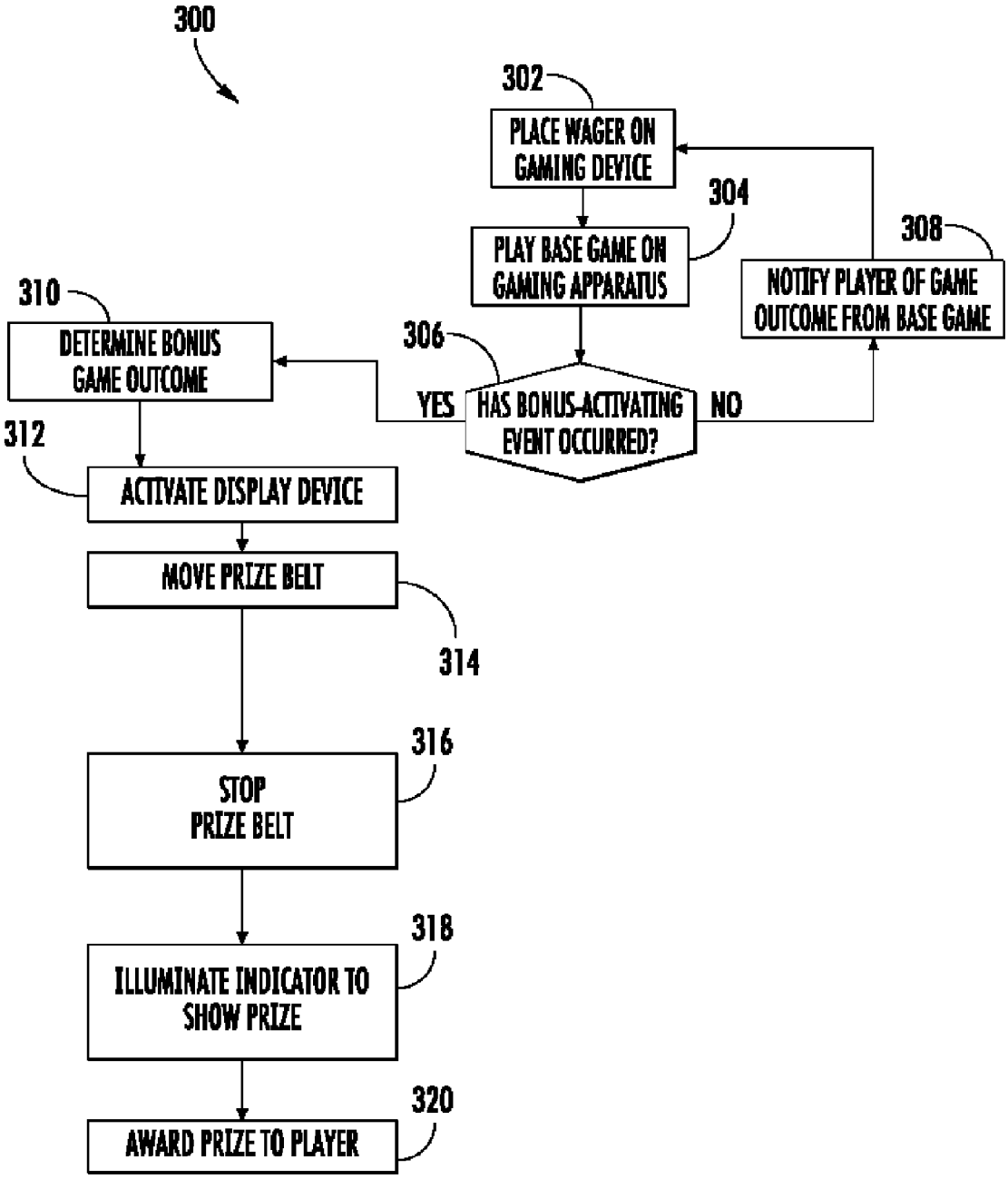
FIG. 7 is substantially a flowchart of a gaming method of the present invention.

One method of operation 300 of gaming device 16 of the present invention is illustrated in FIG. 7. A player places a wager on gaming apparatus 20 in step 302. Method 300 proceeds to allow the player to play a game and determine a game outcome in step 304. At decision 306, method 300 checks to see if the game outcome determined in step 304 is an outcome qualifying the player to play a bonus game. If not, method 300 proceeds to step 308, notifies the player of the game outcome and awards the player any prizes awarded according the game outcome determined in step 304 and returns to step 302.

If it is determined in step 306 that the game outcome of step 304 qualifies the player for a bonus game, method 300 proceeds to step 310. At step 310, controller 176 randomly determines the game outcome or prize. At step 312, display device 60 is activated. This may include rotation of prize belt 62 and activation of player input devices 114 and 116. Lights and sounds may also be activated to make the event more exciting to the player and those around the player, as well as to call attention to the device.

Method 300 then proceeds to step 314 where belt 62 is rotated. At step 316, controller 176 stops rotation of belt 62 at an appropriate location such that the indicia corresponding to the game outcome can be indicated. One of indicators 90 is illuminated at step 318 indicating the indicia 68 corresponding to the game outcome. Method 300 then awards any prizes to the player in step 320.

Many variations of this method can be made without departing from the scope of the present invention. For example, one of indicators 90 could first be illuminated and then prize belt 62 rotated and stopped to indicate the game outcome. Alternatively, the bonus game could be played separately without the use of base game apparatus 20. Another variation of method 300 could include awarding the game player multiple bonus rounds. In this embodiment, the method steps 310-320 are repeated a number of times. The number of times that the method repeats can depend on many different things, such as an outcome of the base game, the amount the player wagered, the bonus outcome, etc. The prize award of each bonus round would be added and awarded as total prize after the last bonus round.

Figure 8:
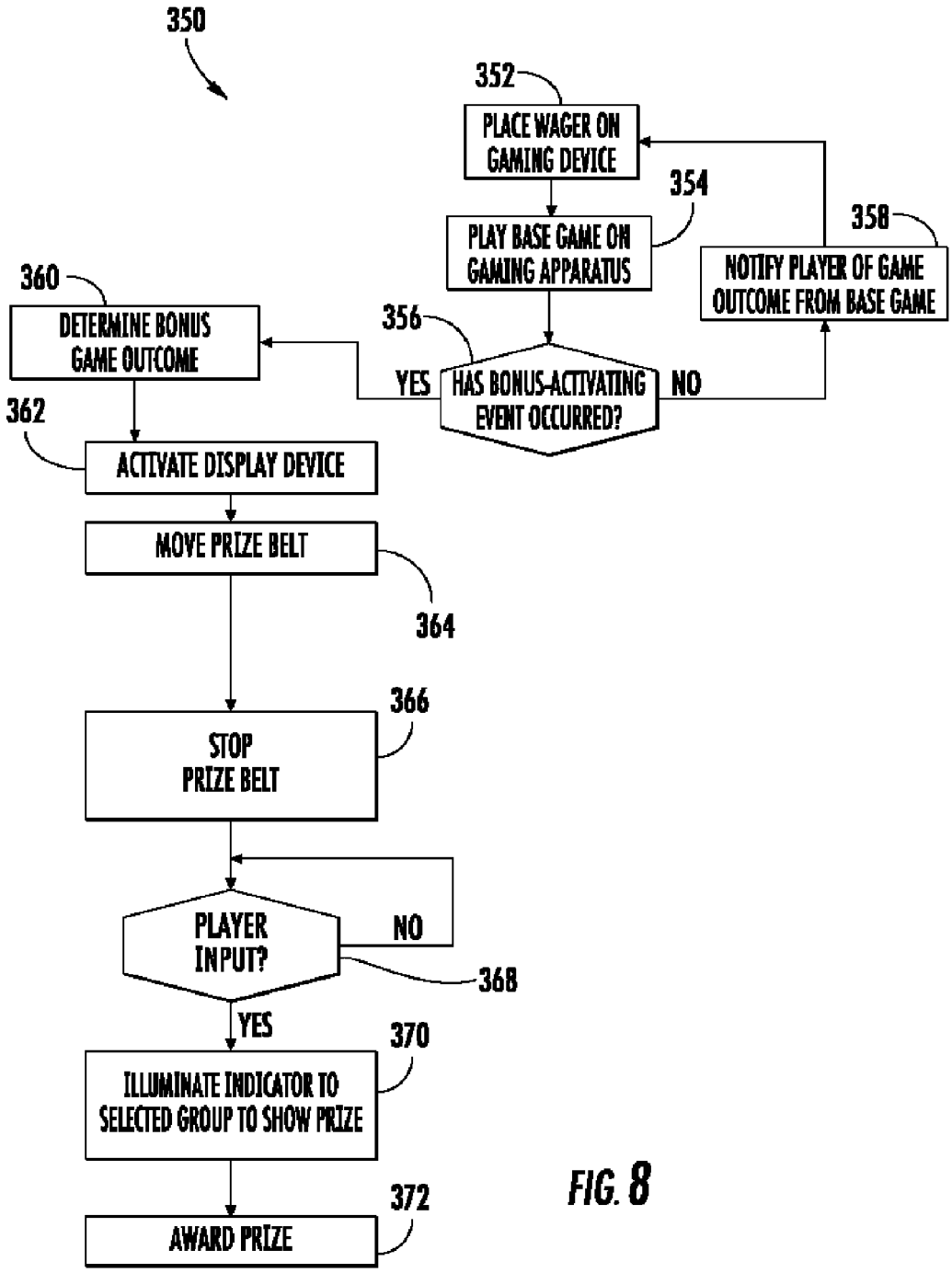
FIG. 8 is substantially a flowchart of another gaming method of the present invention.

Another method of operation 350 of gaming device 16 of the present invention is illustrated in FIG. 8. A player places a wager on gaming apparatus 20 in step 352. Method 350 proceeds to allow the player to play a game and determine a game outcome in step 354. At decision 356, method 350 checks to see if the game outcome determined in step 354 is an outcome qualifying the player to play a bonus game. If not, method 350 proceeds to step 358, notifies the player of the game outcome and awards the player any prizes awarded according the game outcome determined in step 354 and returns to step 352.

If it is determined in step 356 that the game outcome of step 354 qualifies the player for a bonus game, method 350 proceeds to step 360. At step 360, controller 176 randomly determines the game outcome or prize.

At step 362, display device 60 is activated. This may include rotation of prize belt 62 and activation of player input devices 114 and 116. Lights and sounds may also be activated to make the event more exciting to the player and those around the player, as well as to call attention to the device.

Method 350 then proceeds to step 364 where belt 62 is rotated. At step 366, controller 176 stops rotation of belt 62 at an appropriate location such that the indicia corresponding to the game outcome can be indicated.

Method 350 proceeds to decision 368, which checks to see whether one of player input devices 114 or 116 has been selected by the player in order to determine which set of indicators 91 or 94 will indicate the game outcome. If player input devices 114 or 116 have not been selected, method 350 waits for player input. If no input has been received after a pre-determined period of time, for example, 1 minute, controller 176 may make a selection for the player.

If decision 368 determines that the player has selected one of player input devices 114 or 116, method 350 proceeds to step 370. At step 370, one of indicators 90 from the selected set of indicators is illuminated indicating the indicia 68 corresponding to the game outcome. Method 350 then awards any prizes to the player in step 372.

Many variations of this method can be made without departing from the scope of the present invention. For example, the indicator could first be selected and illuminated and then prize belt 62 rotated and stopped to indicate the game outcome. Alternatively, the bonus game could be played separately without the use of base game apparatus 20.

In another embodiment, player input devices 114 and 116 could be used to control the movement and position of prize belt 62. Player input devices 114 and 116 could be move and stop buttons. Once the player has chosen a position to stop prize belt 62, controller 176 can illuminate the appropriate indicator 90 to display a prize.

In another embodiment, the game outcome indicia 68 could be backlit using a lighting device (not shown) to provide a visually attractive display. In this example, the use of indicators 90 could be omitted.

Another variation of method 350 could include awarding the game player multiple bonus rounds. In this embodiment, the method steps 360-372 are repeated a number of times as determined by controller 176. The prize award of each bonus round would be added and awarded as total prize after the last bonus round.

Various additions, subtractions, and permutations of the steps in the above described methods can be made without departing from the scope of the present invention. For example, the player may be allowed to select both the position of belt 62 and which set of indicators 91 or 94 are to indicate the game outcome. However, the player would not control the final illumination of one of indicators 90. The more the player is allowed to interact with gaming device 60, the more control over the outcome of the game the player may feel, which may make the game more enjoyable to the player. Of course, regulatory concerns may dictate that the player's perceived control be largely or completely illusionary.

First Additional Bonus Game Embodiment

Figure 9:
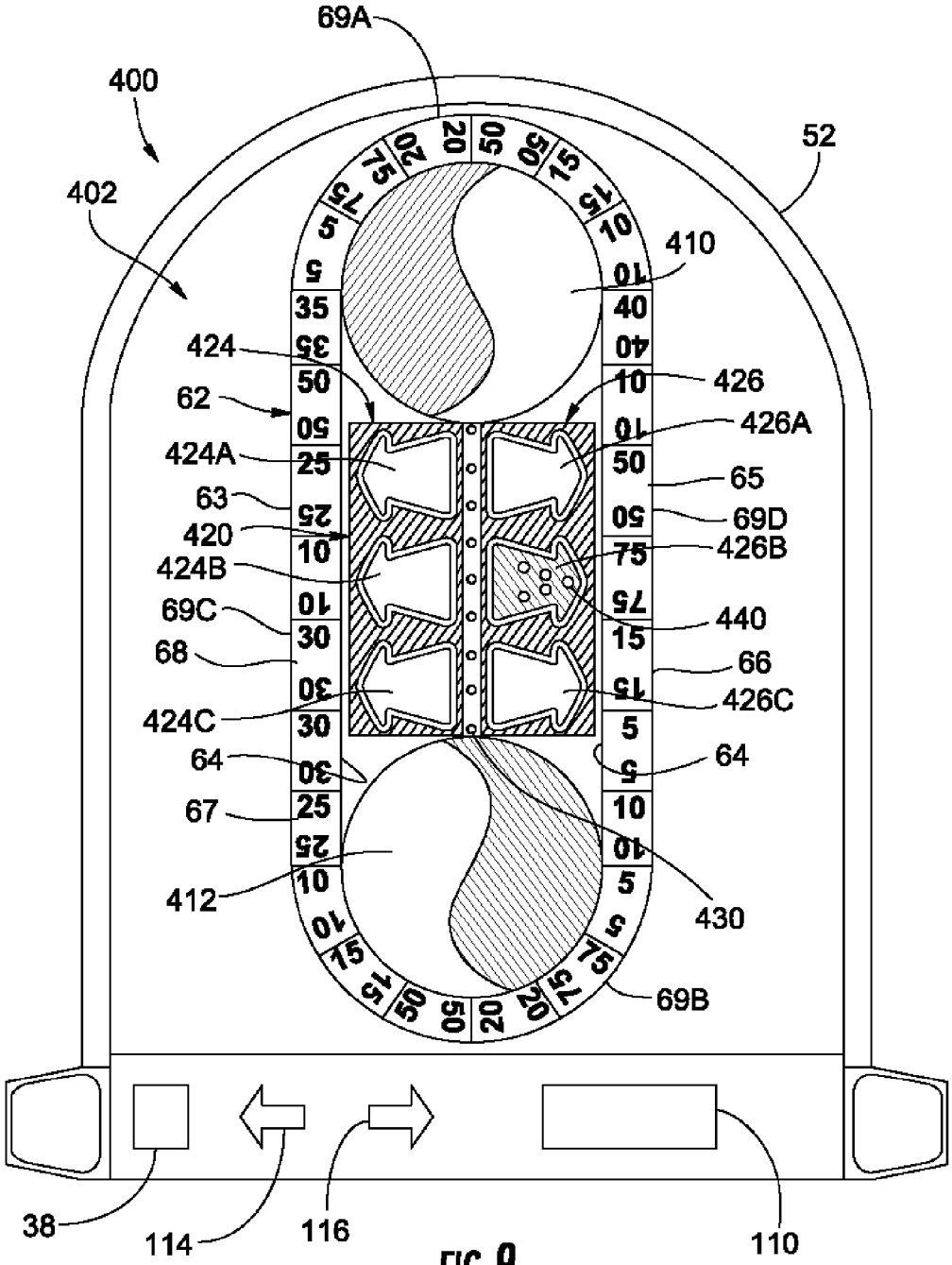
FIG. 9 is substantially a front view of an alternative bonus gaming apparatus of the present invention showing another embodiment of a display device.

Referring to FIG. 9, another embodiment of a bonus game 400 is shown. Bonus game 400 can be configured to display at least one game and prize to a player. Bonus game 400 can have a display device 402. In at least one embodiment, display device 402 is configured to display a bonus game and at least one bonus prize to the player. In other embodiments, display device 402 may provide a primary game. Alternatively, display device 402 may be a stand-alone device allowing a player to place a wager and play a game.

In at least one embodiment, display device 402 is attached to gaming device 20 and positioned on top of gaming device 20. In other embodiments (not shown), display device 402 may be separate from gaming device 20 but in communication with gaming device 20. In this embodiment, gaming device 20 may be in communication with a plurality of different gaming devices 20 via a computer network in a manner that is well known in the art. Display device 402 may also be positioned adjacent to or remote from gaming device 20. In other embodiments, display device 402 is a stand-alone display not in communication with gaming device 20, and it may be capable of independently accepting wagers, conducting games, and awarding prizes to a player.

With continued reference to FIG. 9, bonus game 400 may comprise a housing 52 having a front panel 53. Housing 52 is similar to that shown in FIGS. 1-5. Display device 402 is mounted in housing 52. Display device 402 can have a button 38 that is used to activate display device 402 and a display 110 that is used to display prizes or credits won on bonus game 400.

Display device 402 may comprise a prize belt or prize band or material 62 that rotates. Prize belt 62 has an outer surface 63, an inner surface 64, a front surface 65 and a back surface 66. Prize belt 62 may have a plurality of prize indicia 68 appearing on front surface 65. Indicia 68 may indicate various prizes such as an award of currency or credits, merchandise, services, game play, jackpots, and progressive prizes. Prize belt 62 may have a variety of different indicia 68 imprinted, or otherwise appearing thereon. Indicia 68 may vary in number, size and content. It may be desirable to arrange indicia 68 on belt 62 such that enough of each type of indicia 68 are included in order that any indicia can be indicated at any position to which belt 62 is moved.

Belt 62 is the same as previously described for FIGS. 1-5. Belt 62 is visible through a portion of front panel 53. Belt 62 is also started, rotated and stopped by a positioning mechanism 70 as previously described for FIGS. 1-5. A decorative cover 410 covers hub 81 (FIG. 3). A decorative cover 412 covers hub 80 (FIG. 3).

In at least one embodiment, display device 402 includes several stationary indicators 420 that are mounted between inner surfaces 64 and covers 410 and 412. Indicators 420 can include a left set of indicators 424 and a right set of indicators 426. Left set of indicators 424 can include three individual indicators 424A, 424B and 424C. Right set of indicators 426 can include three individual indicators 426A, 426B and 426C. Indicators 420 are mounted in housing 52 such that they can be viewed through a portion of front panel 53.

Indicators 420 preferably are made from a translucent material such as plastic and include one or more lights 440 that are mounted within or behind indicators 420. Lights 440 can call attention to indicators 420 and make indicator 420 more attractive. Lights 440 may be of any suitable type, including light emitting diodes (LEDs). Lights 440 are in communication with and connected to controller 176 (FIG. 5). Lights 430 may also be used with display device 402. Lights 430 may be flashed or sequenced in an attractive manner in order to draw attention to bonus game device 400.

In at least one embodiment, one or more of lights 440 are turned on or illuminated such that one of indicators 420 points to a selected prize on belt 62 and indicates a game outcome to the game player.

Alternatively, indicators 420 could be replaced by a video display (not shown) that displays a video presentation of six indicators. The video display can highlight or flash one of the indicators to indicate a game outcome.

FIG. 9 also has player input devices 114 and 116 that allow the player to indicate his or her choice. In one preferred embodiment, player input devices 114 and 116 are buttons that allow the player to select one of indicator sets 424 or 426 to display a prize. For example, the player would press the left button 114 to select the left set of indicators 424 to point to a prize indicia 68. The player would press the right button 116 to select the right set of indicators 426 to point to a prize indicia 68. Alternatively, a touch screen (not shown) may be provided in place of or in addition to buttons 114 and 116.

Player input devices 114 and 116 allow a game player to partially control the outcome of bonus game 400. While the player is allowed to select which set of indictors 424 or 426 display the prize indicia, the final illuminated indicator and prize indicia that is displayed is controlled by controller 176.

The use of the player input devices 114 and 116 provides the game player with the illusion of a sense of control over the game. Of course, regulatory concerns may dictate that the player's perceived control be largely or completely illusionary.

The operation of bonus game 400 is similar to that previously described for bonus game 50. Controller 176 determines the prize indicia 68 to be displayed and the prize to be awarded. The controller activates positioning mechanism 70 and moves belt 62 to the desired position. At the appropriate time, controller 176 stops belt 62 and illuminates or turns on lights 440 in one of indicators 420. This allows the game player to view a prize. In FIG. 9, indicator 426B is illuminated pointing to a prize of 75 credits.

Controller 176 may then cause display 110 to display the prize, if any, that the player has won. Other effects may also be presented, such as pre-recorded sound from speakers. In an alternative embodiment, one of indicators 420 can first be illuminated and then the rotation of belt 62 can be stopped in order to display a game outcome.

It is also possible to replace the primary display of a gaming device with display device 402. Game apparatus 20 may be entirely replaced by display device 402. In other words bonus gaming apparatus 400 can be used as a primary or base game apparatus.

In another embodiment, the player could be allowed to select which set of indicators points to the prize or game outcome. For example, the player could use player input devices 114 and 116 to select one of indicator sets 424 or 426 to display a prize. The player could press the left button 114 to select the left set of indicators 424. Controller 176 would then rotate and stop belt 62 and illuminate one of the indicators 424A, 424B or 424C to display the game outcome. Alternatively, belt 62 could be stopped prior to the game player's selection using input devices 114 and 116.

The method of operation of bonus game 400 without the use of player input devices 114 and 116 is the same as previously shown and described in FIG. 7.

The method of operation of bonus game 400 using player input devices 114 and 116 is the same as previously shown and described in FIG. 8 except that the player is selecting the left 424 and right 426 sets of indicators instead of the upper and lower sets of indicators.

Second Additional Bonus Game Embodiment

Figure 10:
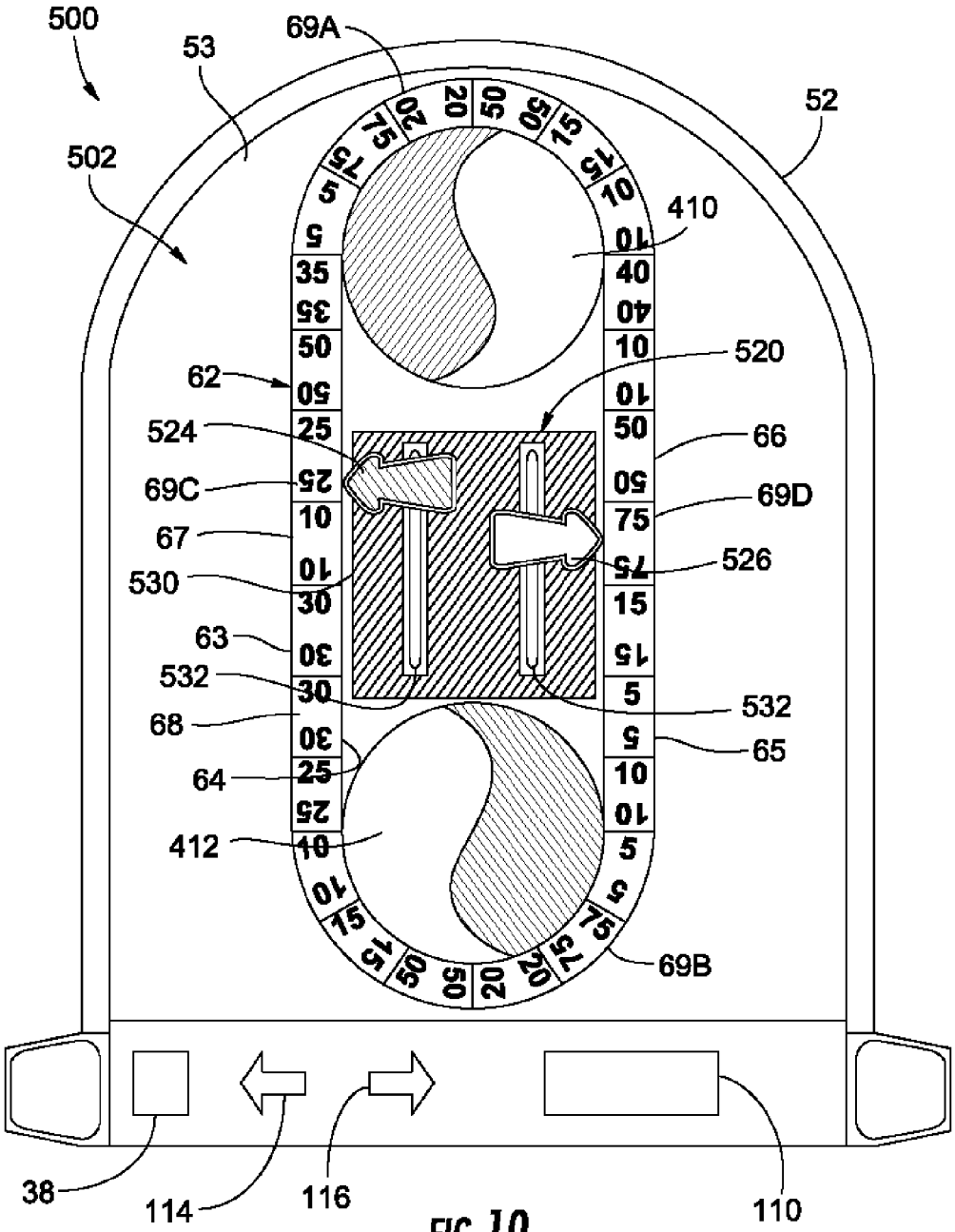
FIG. 10 is substantially a front view of another bonus gaming apparatus of the present invention showing another embodiment of a display device.
Figure 11:
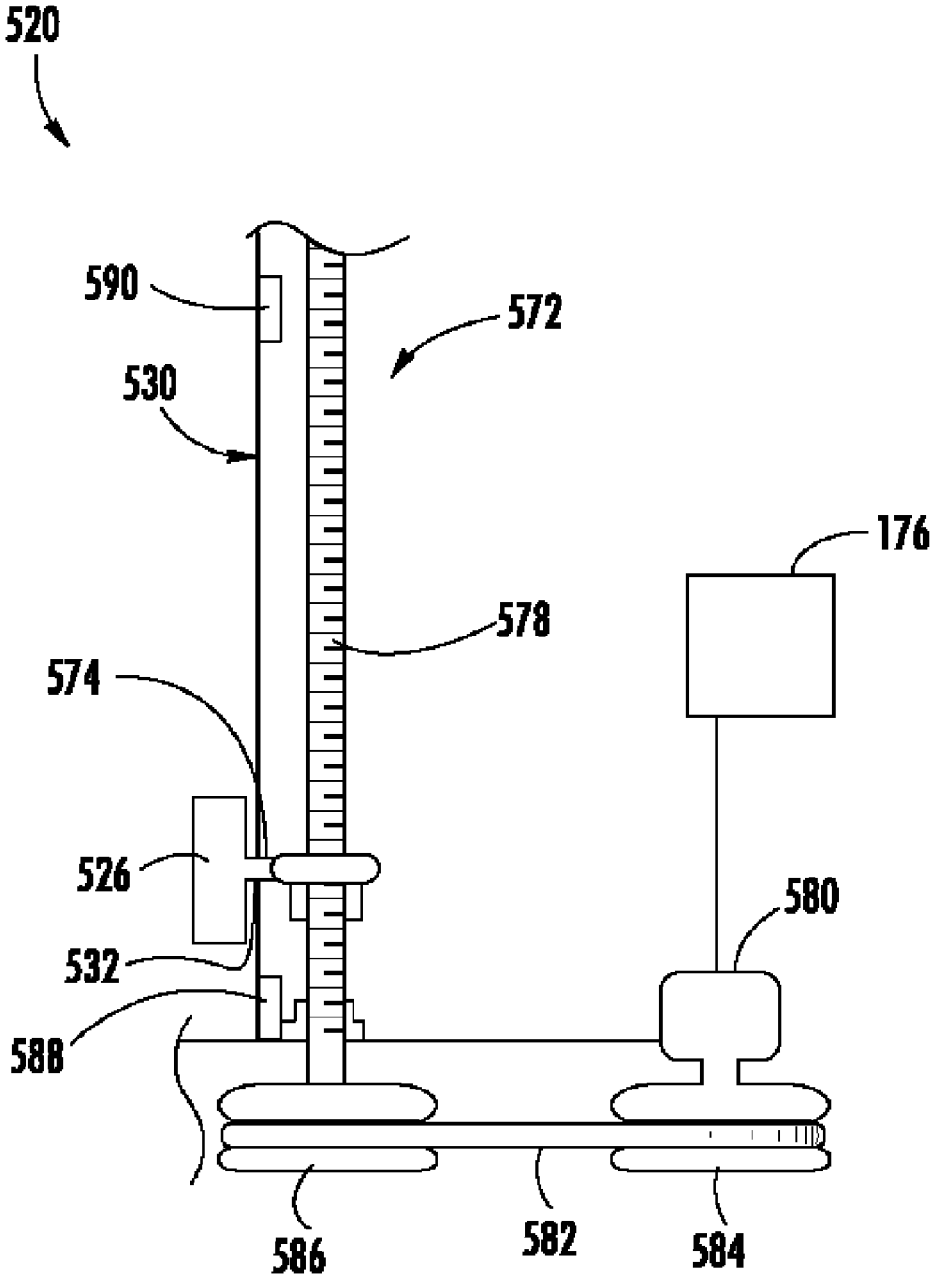
FIG. 11 is substantially a side elevation view of an indicator and positioning mechanism of the gaming apparatus of FIG. 10.
Figure 12:
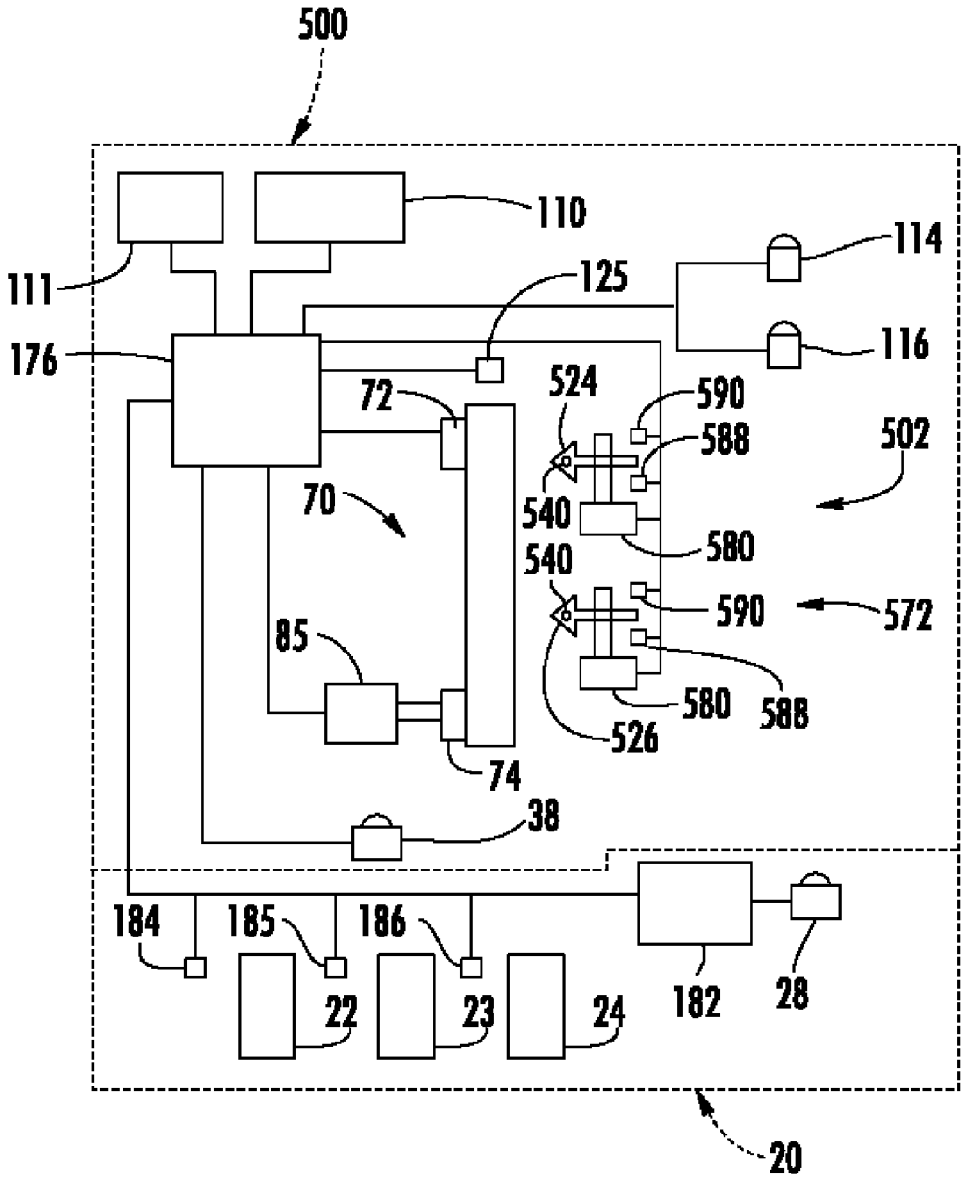
FIG. 12 is substantially a schematic diagram showing components of an embodiment of the gaming apparatus of FIG. 10.

Referring to FIGS. 10, 11 and 12 another embodiment of a bonus game 500 is shown. Bonus game 500 can be configured to display at least one game and prize to a player. Bonus game 500 can have a display device 502. In at least one embodiment, display device 502 is configured to display a bonus game and at least one bonus prize to the player. In other embodiments, display device 502 may provide a primary game. Alternatively, display device 502 may be a stand-alone device allowing a player to place a wager and play a game.

In at least one embodiment, display device 502 is attached to gaming device 20 and positioned on top of gaming device 20. In other embodiments (not shown), display device 502 may be separate from gaming device 20 but in communication with gaming device 20. In this embodiment, gaming device 20 may be in communication with a plurality of different gaming devices 20 via a computer network in a manner that is well known in the art. Display device 502 may also be positioned adjacent to or remote from gaming device 20. In other embodiments, display device 502 is a stand-alone display not in communication with gaming device 20, and it may be capable of independently accepting wagers, conducting games, and awarding prizes to a player.

With continued reference to FIGS. 10-12, bonus game 500 may comprise a housing 52 having a front panel 53. Housing 52 is similar to that shown in FIGS. 1-5. Display device 502 is mounted in housing 52. Display device 502 can have a button 38 that is used to activate display device 502 and a display 110 that is used to display prizes or credits won on bonus game 500.

Display device 502 may comprise a prize belt or prize band or material 62 that rotates about a plurality of rollers 72 and 74. Prize belt 62 has an outer surface 63, an inner surface 64, a front surface 65 and a back surface 66. Prize belt 62 may have a plurality of prize indicia 68 appearing on front surface 65. Indicia 68 may indicate various prizes such as an award of currency or credits, merchandise, services, game play, jackpots, and progressive prizes. Prize belt 62 may have a variety of different indicia 68 imprinted, or otherwise appearing thereon. Indicia 68 may vary in number, size and content. It may be desirable to arrange indicia 68 on belt 62 such that enough of each type of indicia 68 are included in order that any indicia can be indicated at any position to which belt 62 is moved.

Belt 62 is the same as previously described for FIGS. 1-5. Belt 62 is visible through a portion of front panel 53. Belt 62 is also started, rotated and stopped by a display positioning mechanism 70 as previously described for FIGS. 1-5. A decorative cover 410 covers hub 81 (FIG. 3). A decorative cover 412 covers hub 80 (FIG. 3).

In at least one embodiment, display device 502 includes several moveable indicators 520 (FIG. 10) that are mounted between inner surfaces 64 and covers 410 and 412. Indicators 520 can include a linearly moveable left indicator 524 and a linearly moveable right indicator 526. The indicators are mounted in front of a cover 530 that can be part of front panel 53. Cover 530 has a pair of slots 532. Indicators 520 are mounted such that they can be moved and viewed through a portion of front panel 53. Indicators 520 are in communication with controller 176.

Referring now to FIG. 11, indicators 520 may be coupled to an indicator positioning mechanism 572. Indicator positioning mechanism 572 can linearly move indicators 520 in a vertical manner. Indicators 520 could also be moved horizontally if desired.

FIG. 11 shows indicator 526 coupled to indicator positioning mechanism 572. Indicator positioning mechanism 572 may be located within the confines of housing 52. Slot 532 in cover 530 allows a bracket 574 to pass through the cover. Positioning mechanism 572 may comprise a worm gear 578 that can be rotated by an actuator 580. In at least one embodiment, actuator 580 is attached to a first wheel 584. Worm gear 578 may be attached to a second wheel 586. A drive belt 582 preferably rotates around the first wheel 584 and second wheel 586, thereby connecting actuator 580 and worm gear 578. Positioning mechanism 572 may communicate with controller 176, which may store information regarding predetermined positions of belt 62. Sensors 588 and 590 are preferably in communication with controller 176 and may be provided to allow controller 176 to detect the position of indicators 520. Other devices may be used to detect the position of indicators 520, such as optical readers and the like.

Indicators 520 preferably are made from a translucent material such as plastic and include one or more lights 540 (FIG. 12) that are mounted within or behind indicators 520. Lights 540 can call attention to indicators 520 and make indicator 520 more attractive. Lights 540 may be of any suitable type, including light emitting diodes (LEDs). Lights 540 are connected to controller 176.

In at least one embodiment, one or more of lights 540 are turned on or illuminated in one of indicators 524 or 526 such that one of the indicators points to a selected prize indicia 68 on belt 62 and indicates a game outcome to the game player. In FIG. 10, indicator 526 is shown illuminated and pointing to an indicia have a value of 75 credits.

Alternatively, indicators 520 could be replaced by a video display (not shown) that displays a video presentation of the indicators. The video display can move, highlight and flash the indicators to indicate a game outcome.

FIG. 10 also has player input devices 114 and 116 that allow the player to indicate his or her choice. In one preferred embodiment, player input devices 114 and 116 are buttons that allow the player to select one of indicators 524 or 526 to display a prize. For example, the player would press the left button 114 to select the left indicator 524 to point to a prize indicia 68. The player would press the right button 116 to select the right indicator 526 to point to a prize indicia 68. Alternatively, a touch screen (not shown) may be provided in place of or in addition to buttons 114 and 116.

Player input devices 114 and 116 allow a game player to partially control the outcome of bonus game 500. While the player is allowed to select which indicators 524 or 526 display the prize indicia, the final prize indicia 68 that is displayed is controlled by controller 176.

The use of the player input devices 114 and 116 provides the game player with the illusion of a sense of control over the game. Of course, regulatory concerns may dictate that the player's perceived control be largely or completely illusionary.

Turning now to FIG. 12, bonus game apparatus 500 comprises a controller 176 that is adapted to control the operation of the game apparatus. The operation of controller 176 and game apparatus 20 are the same as previously described for FIG. 5.

When controller 176 detects input device 38 being activated, the controller would activate stepper motor or actuator 85 causing belt 62 to begin to rotate or spin. Alternatively, the belt 62 may begin to rotate automatically after the detection of a bonus qualifying event. In another embodiment, controller 176 may wait a predetermined time period for the player to activate input device 38. If the player does not activate input device 38 in that time period, controller 176 would automatically activate display device 502 and initiate the display sequence.

Controller 176 performs a routine to determine which prize indicia 68 will be stopped or displayed in a particular position. This may be performed by a number of methods that are well known in the art. For example, prize indicia 68 may be sequentially displayed or displayed based on external events, such as certain bonus activating events may always cause the same prize ball to be displayed.

In the preferred embodiment, however, prize indicia 68 are randomly selected. Controller 176 generates a random number and then compares the random number to a pay table similar to that described for game apparatus 20 or as described in U.S. Pat. No. 5,823,874, issued to Adams. A simple pay table may appear as follows:

TABLE 1

| Random Number | Bonus Credits | Amount Paid |
|---|---|---|
| 0.00 to 0.50 | 5 | $5.00 |
| 0.51 to 0.75 | 10 | $10.00 |
| 0.76 to 0.95 | 20 | $20.00 |
| 0.96 to 1.00 | 75 | $75.00 |

For example, if the random number generator produced 0.65, 10 credits would be displayed and $10.00 would be awarded to the player. If the random number generator produced 0.80, 20 credits would be displayed. Other awards such as prize multipliers of some amount produced by game apparatus 20 can also be used. Gaming apparatus 20, for instance, may award $20 and the multiplier prize object would multiply this by two, awarding the player $40.

This embodiment is not necessarily limited to the example pay table shown. A greater number of prize objects may be used and, as will be discussed below, a combination of prize objects may be displayed. Furthermore, different kinds of prizes, besides monetary prizes, may be awarded. For example, the prizes may be goods, services, or additional games. The goods and services may be awarded in the form of physical objects, tickets, vouchers, coupons, etc. Additional games may be presented in the form of tickets, such as scratch off lottery tickets. In the embodiments in which tickets, vouchers, and coupons are used, the objects are dispensed using an internally or externally mounted dispenser 111. Such dispensers are well known in the art.

Once controller 176 determines the prize indicia 68 to be displayed and the prize to be awarded, the controller activates display positioning mechanism 70 and indicator positioning mechanism 572. Display positioning mechanism 70 and indicator positioning mechanism 572 are adapted to position and indicate at least one selected prize indicia 68 so that it can be displayed. Positioning mechanisms 70 and 572 may utilize a large variety of devices to achieve its purpose. In an embodiment, belt 62 and indicators 520 are moved to a position where one of indicators 520 are illuminated to point to one of prize indicia 68. Front belt surface 65 can have indicia 68 positioned thereon. Thus, indicia 68 may be positioned by rotating belt 62.

Display positioning mechanism 70 comprises a stepper motor 85 for rotating and stopping belt 62. A sensor 125 can be provided for determining the position of belt 62. The position of each indicia 68 is stored in memory in controller 176. Stepper motor 85 can stop belt 62 at the location determined by the random number generator.

Sensor 125 can be any suitable sensor. For example, sensor 125 may be an infrared source and detector and belt outer surface 63 may comprise portions with different reflective characteristics, such as physical holes or gaps or absorbent paint lines.

Alternatively, a side of belt 62 can contain a series of holes (not shown), cut-out portions, or similar optical interrupts. The optical interrupts may be read by an optical reader (not shown). The optical interrupts may convey the position of belt 62 to controller 176. Sensor 125 may be used to verify that the belt is in the proper position. If sensor 125 does not detect the belt in its proper position, controller 176 may enter an error mode.

Indicator positioning mechanism 572 comprises a pair of actuators 580 for moving and stopping indicators 524 and 526. Rotating actuator 580 turns wheel 584 and wheel 586 through belt 582. The rotation of wheel 586 turns worm gear 578 causing the movement of indicators 524 and 526. Sensors 588 and 590 can be provided for determining the position of indicators 524 and 526. Sensors 588 and 590 can be any suitable sensor. Actuator 580 can stop indicators 524 and 526 at the location determined by controller 176.

In normal operation, after controller 176 has determined which prize indicia 68 is to be displayed, the controller rotates belt 62 and moves indicators 524 and 526 until the desired prize indicia 68 is aligned with the desired indicator that is to be illuminated. At the appropriate time, controller 176 stops belt 62, stops indicators 524 and 526 and illuminates or turns on one of lights 540 behind a corresponding indicator. This allows the game player to view a prize.

Controller 176 may then cause display 110 to display the prize, if any, that the player has won. Other effects may also be presented, such as pre-recorded sound from speakers. If the actual prize is money, the amount of the prize may be added to the player's credit meter or the prize may be dispensed from dispenser 111 or coin dispenser 27.

Combinations of prize indicia 68 can be used to indicate various bonus outcomes. For example, indicator 524 could point to a prize indcia and indicator 526 could point to another prize indicia. The two prize indicias could be added and awarded as a total prize to the game player.

In an alternative embodiment, one of indicators 524 or 526 could first be illuminated and then the rotation of belt 62 can be stopped in order to display a game outcome.

It is also possible to replace the primary display of a gaming device with display device 502. Game apparatus 20 may be entirely replaced by display device 502. In other words bonus gaming apparatus 500 can be used as a primary or base game apparatus.

In another embodiment, the player could be allowed to select which indicator points to the prize or game outcome. For example, the player could use player input devices 114 and 116 to select one of indicators 524 or 526 to display a prize. The player could press the left button 114 to select the left indicator 524. Controller 176 would illuminate indicator 524. Controller 176 would then rotate and stop belt 62 and move and stop indicator 524 to display the game outcome. Alternatively, belt 62 could be stopped prior to the game player's selection using input devices 114 and 116. Alternatively, the indicators 520 could be stopped prior to the game player's selection using input devices 114 and 116.

Figure 13:
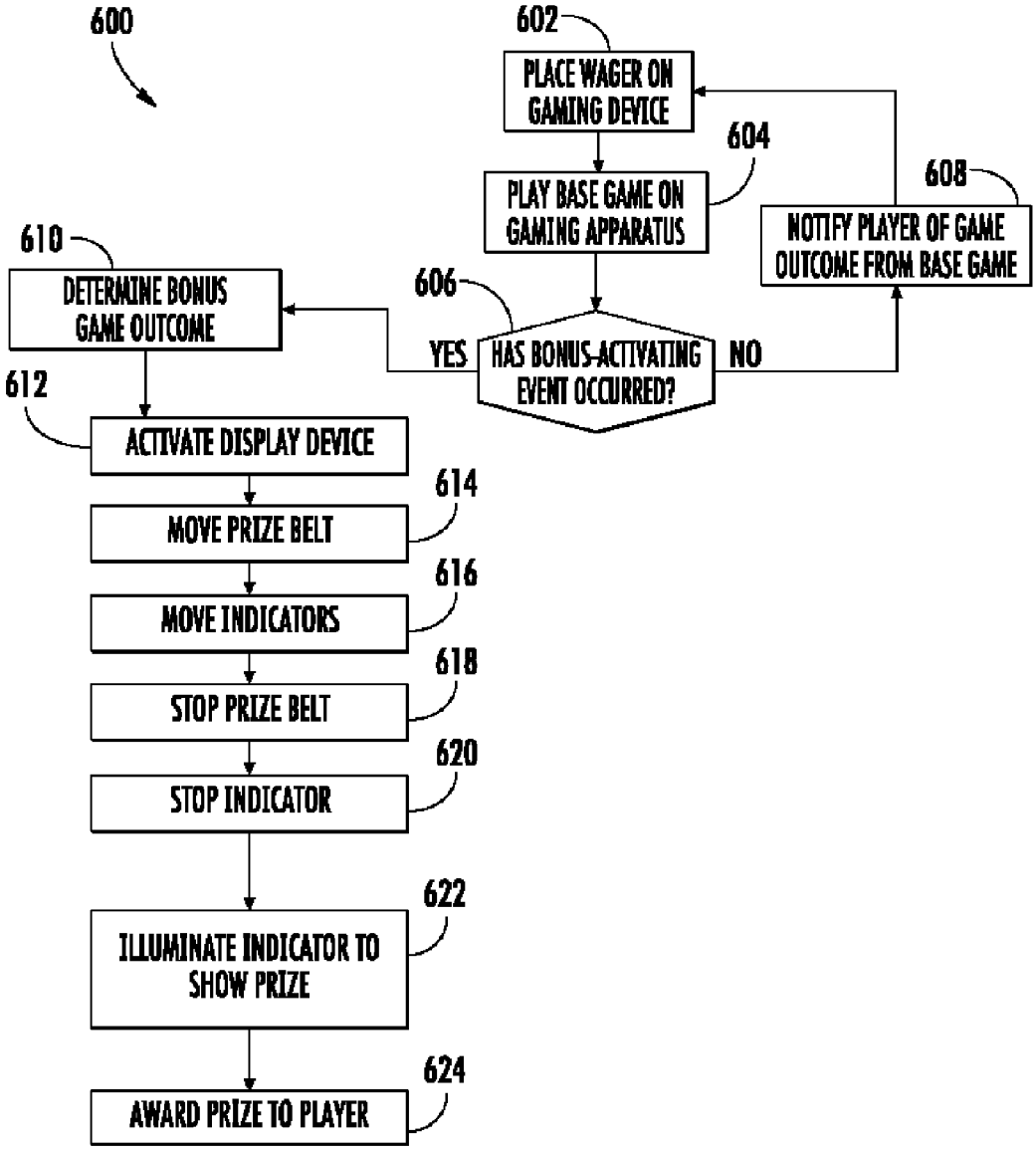
FIG. 13 is substantially a flowchart of a gaming method of the present invention.

One method of operation 600 of gaming device 500 of the present invention is illustrated in FIG. 13. A player places a wager on gaming apparatus 20 in step 602. Method 600 proceeds to allow the player to play a game and determine a game outcome in step 604. At decision 606, method 600 checks to see if the game outcome determined in step 604 is an outcome qualifying the player to play a bonus game. If not, method 600 proceeds to step 608, notifies the player of the game outcome and awards the player any prizes awarded according the game outcome determined in step 604 and returns to step 602.

If it is determined in step 606 that the game outcome of step 604 qualifies the player for a bonus game, method 600 proceeds to step 610. At step 610, controller 176 randomly determines the game outcome or prize. At step 612, display device 502 is activated. This may include rotation of prize belt 62, movement of indicators 520 and activation of player input devices 114 and 116. Lights and sounds may also be activated to make the event more exciting to the player and those around the player, as well as to call attention to the device.

Method 600 then proceeds to step 614 where belt 62 is moved or rotated. At step 616, indicators 524 and 526 are moved. Controller 176 stops rotation of belt 62 at an appropriate location such that the indicia corresponding to the game outcome can be indicated at step 618. At step 620 indicators 524 and 526 are stopped. One of indicators 524 or 526 is illuminated at step 622 indicating the indicia 68 corresponding to the game outcome. Method 600 then awards any prizes to the player in step 624.

Many variations of this method can be made without departing from the scope of the present invention. For example, the indicators could be stopped before stopping the belt. In another example, one of the indicators could first be illuminated and then the prize belt and indicator stopped to indicate the game outcome. Alternatively, the bonus game could be played separately without the use of base game apparatus 20.

Another variation of method 600 could include awarding the game player multiple bonus rounds. In this embodiment, the method steps 610-624 are repeated a number of times as determined by controller 176. The prize award of each bonus round would be added and awarded as total prize after the last bonus round.

Figure 14:
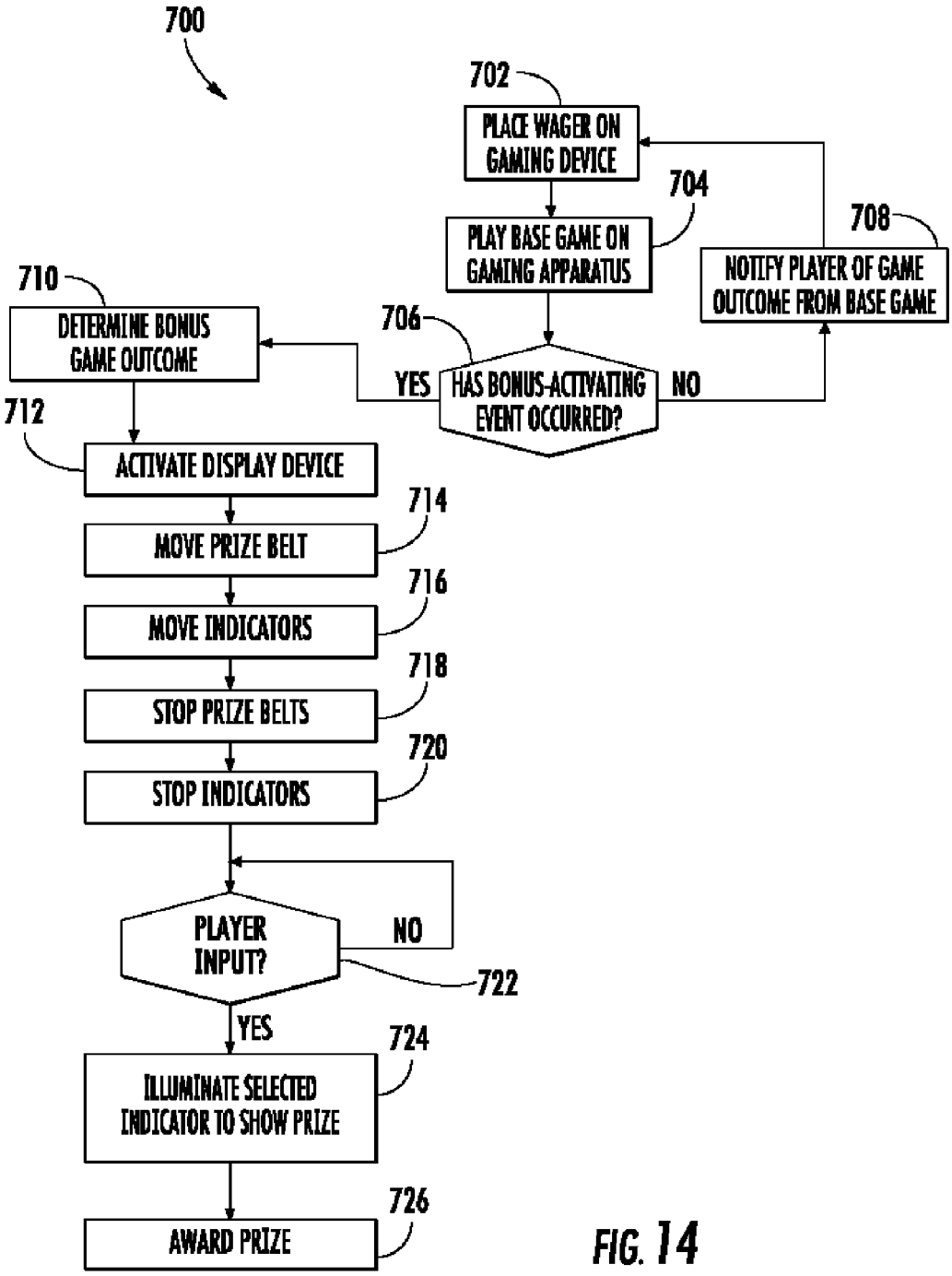
FIG. 14 is substantially a flowchart of another gaming method of the present invention.

Another method of operation 700 of gaming device 500 of the present invention is illustrated in FIG. 14. A player places a wager on gaming apparatus 20 in step 702. Method 700 proceeds to allow the player to play a game and determine a game outcome in step 704. At decision 706, method 700 checks to see if the game outcome determined in step 704 is an outcome qualifying the player to play a bonus game. If not, method 700 proceeds to step 708, notifies the player of the game outcome and awards the player any prizes awarded according the game outcome determined in step 704 and returns to step 702.

If it is determined in step 706 that the game outcome of step 704 qualifies the player for a bonus game, method 700 proceeds to step 710. At step 710, controller 176 randomly determines the game outcome or prize.

At step 712, display device 502 is activated including prize belt 62, indicators 524 and 526 and activation of player input devices 114 and 116. Lights and sounds may also be activated to make the event more exciting to the player and those around the player, as well as to call attention to the device.

Method 700 then proceeds to step 714 where belt 62 is moved or rotated. At step 716, indicators 524 and 526 are moved. At step 718, controller 176 stops movement or rotation of belt 62. At step 720, controller 176 stops movement of indicators 524 and 526 at an appropriate location such that the indicia corresponding to the game outcome can be indicated.

Method 700 proceeds to decision 722, which checks to see whether one of player input devices 114 or 116 has been selected by the player in order determine which indicator 524 or 526 will indicate the game outcome. If player input devices 114 or 116 have not been selected, method 700 waits for player input. If no input has been received after a pre-determined period of time, for example, 1 minute, controller 176 may make a selection for the player.

If decision 722 determines that the player has selected one of player input devices 114 or 116, method 700 proceeds to step 724. At step 724, the selected indicator 524 or 526 is illuminated indicating the indicia 68 corresponding to the game outcome. Method 700 then awards any prizes to the player in step 726.

Many variations of this method can be made without departing from the scope of the present invention. For example, the indicator could first be selected by the player and illuminated and then prize belt 62 moved and stopped and the indicator moved and stopped to indicate the game outcome. Alternatively, the bonus game could be played separately without the use of base game apparatus 20.

In another example, the order of the steps can be changed. Step 714 and step 716 could be reversed. Similarly, steps 718 and 720 could be reversed with the indicator movement being stopped prior to stopping movement of the prize belt.

In another example, the prize belt could be moved and stopped and then the indicators moved and stopped. The player would then be allowed to select which indicator points to the game outcome.

In another embodiment, player input devices 114 and 116 could be used to control the movement and position of prize belt 62. Player input devices 114 and 116 could be move and stop buttons. Once the player has chosen a position to stop prize belt 62, controller 176 can move and illuminate the appropriate indicator 520 to display a prize.

In another embodiment, player input devices 114 and 116 could be used to control the movement and position of indicators 520. Player input devices 114 and 116 could be move and stop buttons. Once the player has chosen a position for an indicator, controller 176 can move prize belt 62 and illuminate the appropriate indicator 520 to display a prize.

Another variation of method 700 could include awarding the game player multiple bonus rounds. In this embodiment, the method steps 710-726 are repeated a number of times as determined by controller 176. The prize award of each bonus round would be added and awarded as total prize after the last bonus round.

Various additions, subtractions, and permutations of the steps in the above described methods can be made without departing from the scope of the present invention. The more the player is allowed to interact with gaming device 500, the more control over the outcome of the game the player may feel, which may make the game more enjoyable to the player. Of course, regulatory concerns may dictate that the player's perceived control be largely or completely illusionary.

CONCLUSION

It can thus be realized that certain embodiments of the present invention provide a highly attractive and entertaining device for displaying prizes. Certain embodiments of the present invention further provide a moveable prize belt and indicator to indicate a bonus prize. Thus, certain embodiments of the present invention can easily catch patrons' attention and invite patrons to play the game. Certain embodiments may further cause players to play longer because the display device enhances the anticipation, stimulation, and excitement experienced by players.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A gaming device comprising:

a. a housing;

b. a display device associated with the housing, the display device having a belt displaying a plurality of indicia, wherein the belt has a front surface, the front surface being oriented such that the front surface is viewable to the game player and wherein an axis of rotation of the belt is parallel to a line of sight of a game player viewing the front surface of the belt;

c. a first positioning mechanism coupled to the belt and configured to move the belt;

d. a plurality of indicators associated with the display device; and e. at least one controller in communication with the first positioning mechanism and the indicators, the controller being configured to determine a game outcome and to direct movement of the belt, the controller further configured to illuminate at least one of the indicators in order to display the game outcome.

2. The gaming device of claim 1, wherein the indicia are mounted on the front surface.

3. The gaming device of claim 1, wherein the plurality of indicators includes at least a first and second set of indicators.

4. The gaming device of claim 3, further comprising a player input device in communication with the controller, wherein the player input device allows a player to choose between the first and second set of indicators, wherein, after the player has activated the player input device, the controller causes at least one of the indicators of the chosen set of indicators to be illuminated and indicate an indicia on the display device that corresponds to the game outcome determined by the controller.

5. The gaming device of claim 1, further comprising a second positioning system connected with the indicators and in communication with the controller, the second positioning system being adapted to move the indicators, the controller further being configured to direct movement of the indicators.

6. A gaming method comprising, but not necessarily in the order shown:

(a) providing a gaming device, the gaming device comprising a plurality of indicators and a moveable belt, the moveable belt having a plurality of indicia;

(b) allowing a player to place a wager;

(c) determining a game outcome, the game outcome corresponding to, and being conveyable by at least one indicia appearing on the moveable belt;

(d) rotating the belt, wherein an axis of rotation of the belt is parallel to a line of sight of a game player viewing the belt;

(e) stopping the belt; and (f) illuminating at least one of the indicators, wherein in combination, the stopped belt and the illuminated indicator indicate an indicia on the moveable belt corresponding to the game outcome.

7. The method of claim 6 further comprising:

(a) providing a player input device; and (b) allowing the player to select a subset of the indicators to be illuminated.

8. The method of claim 6, further comprising moving the indicators in a linear manner.

9. The method of claim 6, further comprising rotating the indicators.

10. A gaming device comprising:

(a) belt means for displaying a plurality of indicia on a front surface of the belt means, the front surface being oriented such that the front surface is viewable to a game player;

(b) indicator means for indicating at least one of the indicia;

(c) display positioning means for rotating the belt means, wherein an axis of rotation of the belt means is parallel to a line of sight of a game player viewing the front surface of the belt means;

(d) lighting means for illuminating the indicator means; and (e) controller means for controlling movement of the belt means and illumination of the indicator means, wherein the controller means is configured to position the belt means and illuminate at least one of the indicator means such that an indicia corresponding to a game outcome is indicated by the indicator means.

11. The gaming device of claim 10 further comprising player input means in communication with the controller means, the player input means allowing a player to select a portion of the indicator means to indicate the game outcome.

12. The gaming device of claim 10 further comprising player input means in communication with the controller means, the player input means allowing a player to at least partially direct movement of the belt means.

13. The gaming device of claim 10 wherein the belt means comprises a moveable belt, the plurality of indicia being affixed to the belt.

14. The gaming device of claim 13 wherein the display positioning means comprises a stepper motor connected to a driven roller, the driven roller being in frictional contact with the moveable belt, the stepper motor adapted to move the moveable belt.

15. The gaming device of claim 10 further comprising indicator positioning means for moving the indicator means.

16. A gaming method comprising, but not necessarily in the order shown:

(a) displaying a plurality of indicia on a moveable belt;

(b) allowing a player to place a wager;

(c) determining a game outcome, the game outcome corresponding to, and being conveyable by at least one indicia appearing on the moveable belt;

(d) rotating the belt wherein an axis of rotation of the moveable belt is parallel to a line of sight of a game player viewing the belt;

(e) illuminating at least one of a plurality of indicators; and (f) stopping the belt, wherein in combination, the stopped belt and the illuminated indicator indicate an indicia on the moveable belt corresponding to the game outcome.

17. The method of claim 16 further comprising:

(a) providing a player input device; and (b) allowing the player to select a subset of the indicators to be illuminated.

18. The method of claim 16, further comprising moving the indicators in a linear manner.

19. The method of claim 16, further comprising rotating the indicators.

* * * * *